US008769898B2

(12) United States Patent
Carolan et al.

(10) Patent No.: US 8,769,898 B2
(45) Date of Patent: Jul. 8, 2014

(54) STRUCTURAL INFILL WALL PANEL MODULE

(75) Inventors: James Carolan, Kingscourt (IE); Gregory Flynn, Collon (IE)

(73) Assignee: Kingspan Research and Developments Limited, Kingscourt, County Cavan (IE)

( * ) Notice: Subject to any disclaimer, the term of this patent is extended or adjusted under 35 U.S.C. 154(b) by 0 days.

(21) Appl. No.: 13/699,501

(22) PCT Filed: Jun. 8, 2011

(86) PCT No.: PCT/IE2011/000030

§ 371 (c)(1),
(2), (4) Date: Dec. 18, 2012

(87) PCT Pub. No.: WO2011/154929

PCT Pub. Date: Dec. 15, 2011

(65) Prior Publication Data

US 2013/0104472 A1 May 2, 2013

(30) Foreign Application Priority Data

Jun. 8, 2010 (IE) ..... 2010/0367
Feb. 9, 2011 (IE) ..... 2011/0058

(51) Int. Cl.
*E04B 2/52* (2006.01)
*E04B 2/08* (2006.01)
*E04C 1/40* (2006.01)

(52) U.S. Cl.
USPC ..... 52/407.4; 52/407.2; 52/404.1; 52/289; 52/235; 52/465; 52/581; 52/782.1

(58) Field of Classification Search
USPC ..... 52/407.4, 407.2, 404.4, 235, 289, 52/461–469, 582.1, 584.1, 404.1–404.5, 52/406.1–406.3, 407.1–407.5, 782.1, 52/588.1, 581, 783.11, 794.1, 796.1
See application file for complete search history.

(56) References Cited

U.S. PATENT DOCUMENTS

| | | | | | |
|---|---|---|---|---|---|
| 2,268,636 | A * | 1/1942 | Becker | 52/580 |
| 2,961,478 | A * | 11/1960 | Burns | 174/363 |
| 3,357,146 | A * | 12/1967 | Gartrell | 52/592.4 |
| 3,474,583 | A * | 10/1969 | Manias | 52/302.7 |
| 4,810,027 | A * | 3/1989 | Ehrlich | 296/186.1 |
| 6,189,273 | B1 * | 2/2001 | Larson | 52/255 |
| 6,279,287 | B1 * | 8/2001 | Meadows | 52/589.1 |
| 6,430,885 | B1 * | 8/2002 | Ito | 52/483.1 |
| 6,450,564 | B1 * | 9/2002 | Sill | 296/186.1 |

FOREIGN PATENT DOCUMENTS

| | | |
|---|---|---|
| AU | 521 784 | 4/1982 |
| EP | 0 051 351 | 5/1982 |
| GB | 2 297 824 | 8/1996 |
| GB | 2 446 521 | 8/2008 |

(Continued)

*Primary Examiner* — Jeanette E. Chapman
(74) *Attorney, Agent, or Firm* — Jacobson Holman, PLLC.

(57) ABSTRACT

A facade/wall system comprises a number of modules. Each module comprises a plurality of insulating panels which have connection means on opposite sides thereof for interengaging the panels together at joints between the panels. Reinforcing elements in the form of top hat sections bridge the joints between adjacent panels. The top hat reinforcement elements used to interconnect adjacent panels in a module ensure that the composite panels act together as monolithic structure that creates a diaphragm while providing a surface to which cladding can be fixed and also providing a cavity between the panels and the cladding attached to the modules. They stiffen the panels and thereby enhance resistance to deflection. The system is cost effective and relatively easy and quick to install.

28 Claims, 35 Drawing Sheets

(56) References Cited

FOREIGN PATENT DOCUMENTS

| | | |
|---|---|---|
| GB | 2 448 614 | 10/2008 |
| IE | 20 030 934 | 6/2004 |
| WO | 99/53155 | 10/1999 |
| WO | 2006/053377 | 5/2006 |

* cited by examiner

STRUCTURAL INFILL WALL PANEL MODULE

This is a national stage of PCT/IE11/000,030 filed Jun. 8, 2011 published in English, which has a priority of Irish no. 2010/0367 filed Jun. 8, 2010, and Irish no. 2011/0058 filed Feb. 9, 2011, hereby incorporated by reference.

INTRODUCTION

Many multi-storey buildings are constructed by first installing a main building frame that defines the various floors of the building. Subsequently external walls are installed between the elements of the main frame. In general, such external walls comprise a metal sub-frame to which various infills and cladding are fitted. However, such metal sub-frames are expensive to manufacture and the systems are time consuming to install. On site detailing errors and poor workmanship on installation can also lead to problems.

There is therefore a need for a wall system which will provide the necessary mechanical and other characteristics but which will be less expensive and less prone to on-site errors than metal sub-frame systems.

STATEMENTS OF INVENTION

According to the invention there is provided a structural infill wall panel module for mounting to a frame of a building, the module comprising:— a plurality of composite insulating panels;

the panels comprising an external sheet, an internal lining sheet, and an insulating core between the external sheet and the internal sheet, the external sheet and the internal sheet having profiled connection parts, the profiled connection parts of the external sheets of adjacent panels being interengagable and the connection parts of the internal sheets of adjacent panels being interengagable at the joint between adjacent panels;

external reinforcing elements mounted to the external sheets and bridging the joint between adjacent panels; and internal reinforcing elements mounted to the internal sheets and bridging the joint between adjacent panels.

In one embodiment the external reinforcing elements are substantially top hat shape having side flanges mounted to external sheets the adjacent panels forming a joint.

In one embodiment the internal reinforcing elements are of substantially top hat shape having side flanges mounted to internal sheets of adjacent panels forming a joint.

Additional reinforcing elements may be mounted to the panels intermediate the sides thereof. The additional reinforcing elements may be mounted to the external sheets of the panels. In one case a single additional reinforcing element is mounted to the external sheet of a panel intermediate the sides thereof.

The additional reinforcing elements may be of substantially top hat shape having side flanges mounted to the sheet.

The panels may be approximately 1200 mm in width. The external reinforcing elements may be spaced apart by a distance of about 600 mm.

In one embodiment the panel module comprises mounting brackets for attachment to an element of a building.

The mounting brackets may comprise an upper mounting bracket and a lower mounting bracket for attachment to upper and lower elements of a building.

In one case the upper and lower elements of the building to which the brackets are attached are slotted to accommodate movement of the panel module relative to the upper and lower elements of the building to which it is attached.

The mounting brackets may be mounted to the internal sheet of the panel.

Panel fixings may be extended through the panel and into the brackets.

In one embodiment a support member extends longitudinally between the brackets. Panel fixings may extend through the panel and into the longitudinal support member for enhanced strength.

The panel module may comprise a flexible seal system at one end of the module for sealing the joint between adjacent modules, on assembly of the module to another like module. In one case the flexible seal comprises a flexible membrane and a block of a compressible material carried by the membrane.

In one embodiment the panel module comprises an integral window or door and a frame comprising vertical and horizontal framing system for framing the window or door.

The framing system may comprise a pair of interengagable frame members. One frame member may be of channel shape and the other frame member is of C-section. The frame members may be fixed together, for example by rivets. The vertical and horizontal framing systems are preferably fixed together at a joint therebetween. In one case the horizontal and vertical framing systems are fixed together using an L-shaped bracket.

In one embodiment the external sheet is of metal such as galvanised steel.

In one embodiment the internal liner sheet is of metal such as galvanised steel.

The invention also provides a façade system comprising at least one panel module of the invention. In one embodiment the façade system comprises support elements mounted to the external reinforcing bridging elements. Cladding elements may be mounted to the support elements.

The invention also provides a building comprising a façade system as described.

The invention also provides a façade system comprising a plurality of composite insulating panels, the panels having connection means on opposite sides thereof for interengaging the panels together at joints therebetween, reinforcing elements bridging the joints between adjacent panels, support elements mounted to the reinforcing bridging elements; and cladding elements mounted to the support elements.

In one embodiment the reinforcing elements are of top hat shape having side flanges for mounting to the adjacent panels forming the joint.

In one case the system comprises additional reinforcing elements mounted to the panels intermediate the sides thereof. A single additional reinforcing element may be mounted to a panel intermediate the sides thereof.

In one case the panels are approximately 1200 mm in width. In this case the reinforcing elements may be spaced-apart by a distance of about 600 mm.

In one embodiment the system comprises reinforcing elements on both internal and external faces of the composite insulating panels.

In one embodiment of the invention the façade system comprises vertical and horizontal framing system for framing an opening.

The framing system may comprise a pair of interengagable frame members. One frame member may be of channel shape and the other frame member may be of C-section. The frame members may be fixed together, for example by rivets.

In one embodiment the vertical and horizontal framing systems are fixed together at a joint therebetween. The horizontal and vertical framing systems may be fixed together using an L-shaped bracket.

In one case the vertical framing systems extend for the full height of the façade system.

In one embodiment the panels comprise an external sheet, an internal liner sheet and an insulating core embedded between the sheets.

The external sheet may be of metal such as galvanised steel. The internal liner sheet may be of metal such as galvanised steel.

In one case the external sheet and the internal sheet comprise connection parts, the connection parts of the external sheets of adjacent panels being interengagable and the connection parts of the internal sheets of adjacent panels being interengagable at the joint between adjacent panels.

BRIEF DESCRIPTION OF THE DRAWINGS

The invention will be more clearly understood from the following description of an embodiment thereof, given by way of example only, with reference to the accompanying drawings, in which:

FIG. 13(*b*) is a perspective view illustrating another fixing arrangement;

FIG. 27(*b*) is another longitudinal cross sectional view of the module adjacent to a building column;

FIG. 27 (*c*) is a cross sectional view of a vertical member which extends between the upper and lower supports in FIG. 27(*b*);

DETAILED DESCRIPTION

Figure 1:
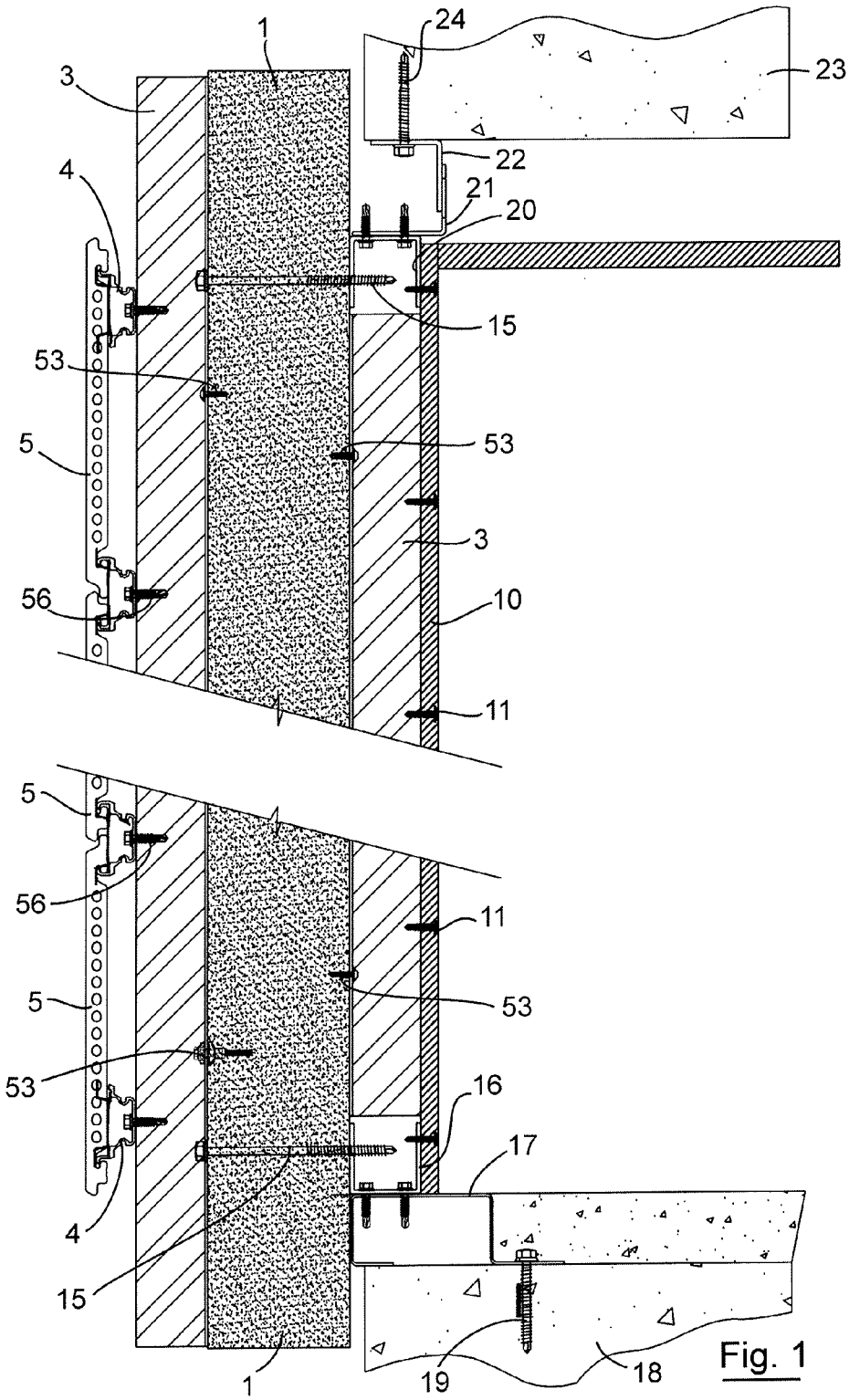
FIG. 1 is a cross sectional view of a wall façade system according to the invention.

Referring to the drawings there is illustrated a wall façade system according to the invention. The system comprises a structural infill modular panel system that is installed into a building mainframe without a requirement for a secondary framing system.

The wall panel module of the invention comprises a plurality of insulating panels 1 which have connection means on opposite sides thereof for interengaging the panels 1 together at joints 2 (see for example FIG. 6) between the panels 1. Reinforcing bridging elements in the form of top hat sections 3 bridge the joints 2 between adjacent panels 1. On the front or external face of the system support elements 4 are mounted to the reinforcing top hat sections 3 and external cladding elements 5 are mounted to the support elements 4.

Additional reinforcing elements in the form of top hat sections 3 are in this case provided mid-way across the width of the panel. For example, if the panels are typically 1200 mm wide the reinforcing elements are mounted to the panel at 600 mm centres.

The internal face of the panels 1 are also provided with bridging/reinforcing elements in the form of tap hat sections 3 to which a suitable internal cladding such as sheets of plasterboard 10 are mounted using suitable fixings 11.

The lower end of a panel module is fixed by panel fixings 15 which extend through the panel 1 to a base bracket which in this case is provided by a U-section beam 16 which is mounted to the panel and which in turn is fixed to a lower building element. The lower building element is in this case provided by a base deflector element 17 which may have substantially a G section form. The element 17 is fixed to a concrete building frame part 18 using a suitable masonry fixing 19. Similarly, the upper end of a panel is fixed by through panel fixings 15 to a head bracket which in this case is provided by a U section beam 20 which in turn is fixed to an upper building element. In this case the upper building element comprises an angle section 21 which is mounted to another angle section 22 which in turn is fixed to an upper concrete building frame part 23 using masonry fixings 24. The base bracket provided by U-section beam 16 may alternatively be of C profile. A U profile may be used to reduce the amount of material in the section 16 without sacrificing performance.

Figure 6:
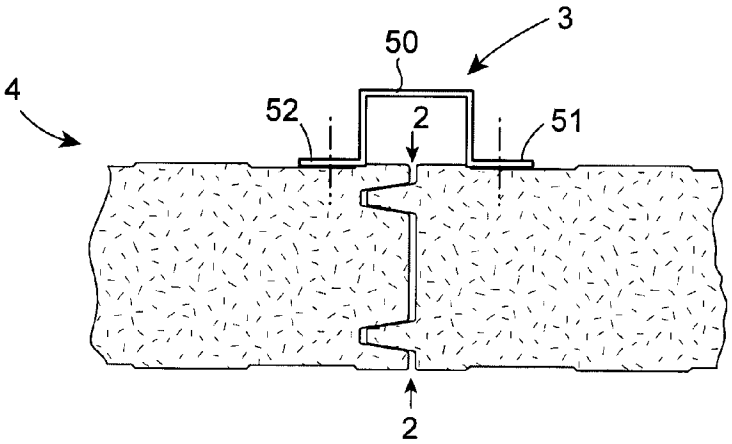
FIG. 6 is a cross sectional view of a joint detail between adjacent insulating panels.
Figure 5:
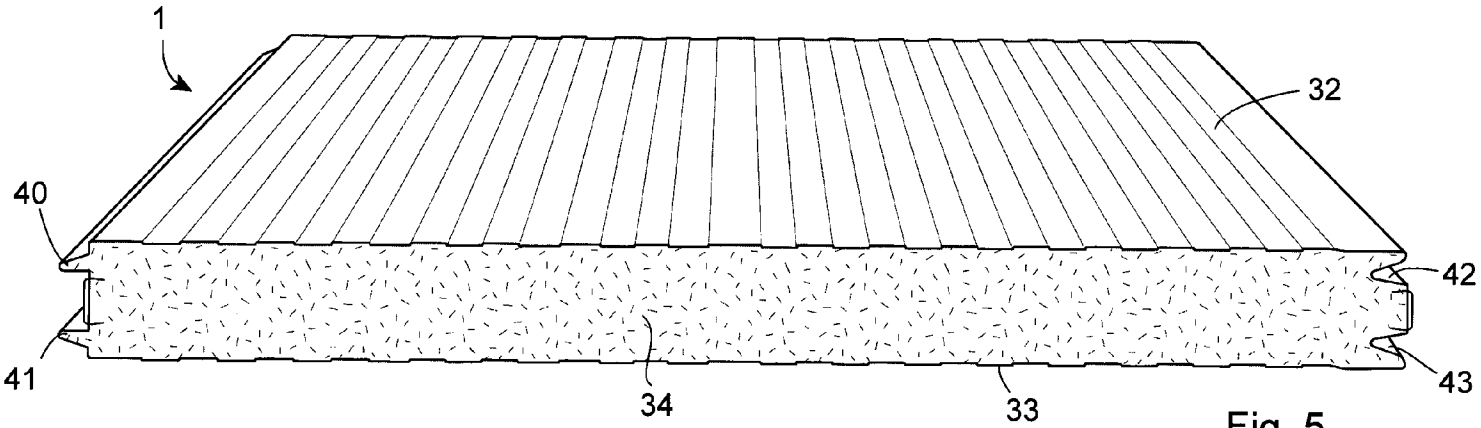
FIG. 5 is a perspective view of a typical insulating panel forming part of the system.

Referring especially to FIGS. 5 and 6 an insulated panel 1 used in the invention comprises an external sheet 32, an internal sheet 33 and an insulating core 34 between the external sheet 32 and internal sheet 33. The sheets 32 and 33 are typically of steel material and the core 34 is of polyurethane, polyisocyanurate, or phenolic foam material which fills the space between the sheets 32, 33.

The external sheet 32 and internal sheet 33 have profiled joint-forming portions for connecting adjacent panels, on assembly as illustrated. This ensures a strong joint between the panels and contributes to the strength of the panel module formed by a number of adjacent panels which are fixed together. The external sheet 32 has an external male projecting part 40 on one side and a corresponding external recess or female part 42 on the opposite side of the panel. A seal may be placed in the recess 42 for sealing engagement, on assembly, with the male projecting part 40, of an adjacent panel. Similarly, the internal sheet 33 has an internal male projecting part 41 on one side for engagement, on assembly, with a corresponding internal recess 43 on the opposite side of an adjacent panel. The double tongue and groove edge alignment of the panels ensures a precise interlocking of the panels and dimensional accuracy. This eliminates the risk of thermal bridging and provides an air-tight joint between the panels when erected. Any thermal, fire or structural requirement can be catered for by using panels of different thicknesses.

On assembly of adjacent panels 1, a joint 2 is formed which is bridged by a reinforcing element in the form of a top hat section 3. Referring especially to FIG. 6 a top hat section 3 comprises a main part 50 of inverted shape (in this case inverted U shape) and flanges 51, 52 extending from the ends of the main part 50. The top hat sections 3 are typically 50 mm high. Suitable fixings such as fixings 55 mentioned below, are extended through the flanges 51, 52 and into the adjacent panels 1 to fix the top hat sections 3 to the panels 1. The top hat section 3 provides a flat part to which the cladding support elements 4 are readily fixed using fixings 56 (see for example FIG. 1).

Figure 2:
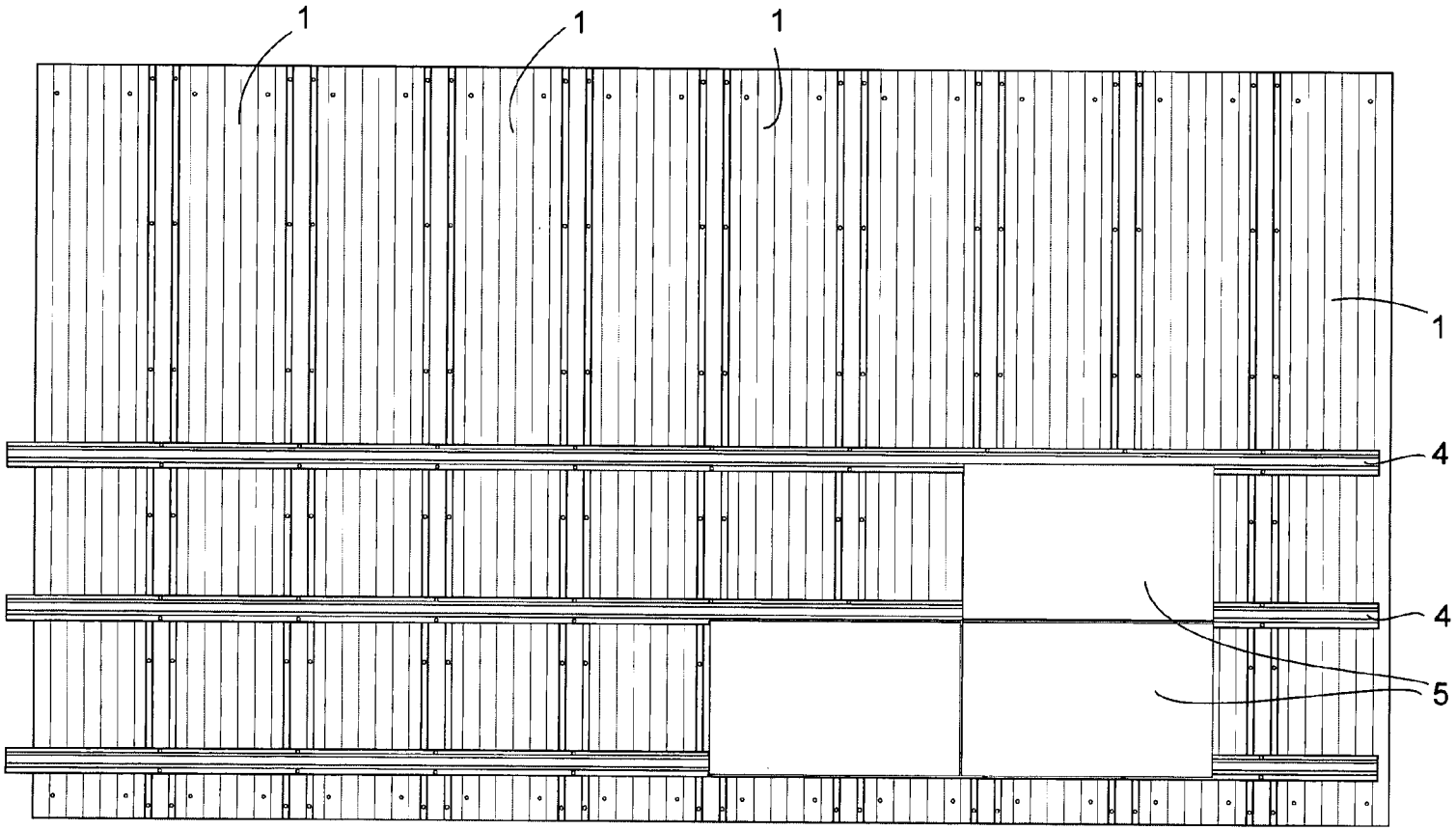
FIG. 2 is an elevational view of part of a façade wall system with most façade elements removed.
Figure 3:
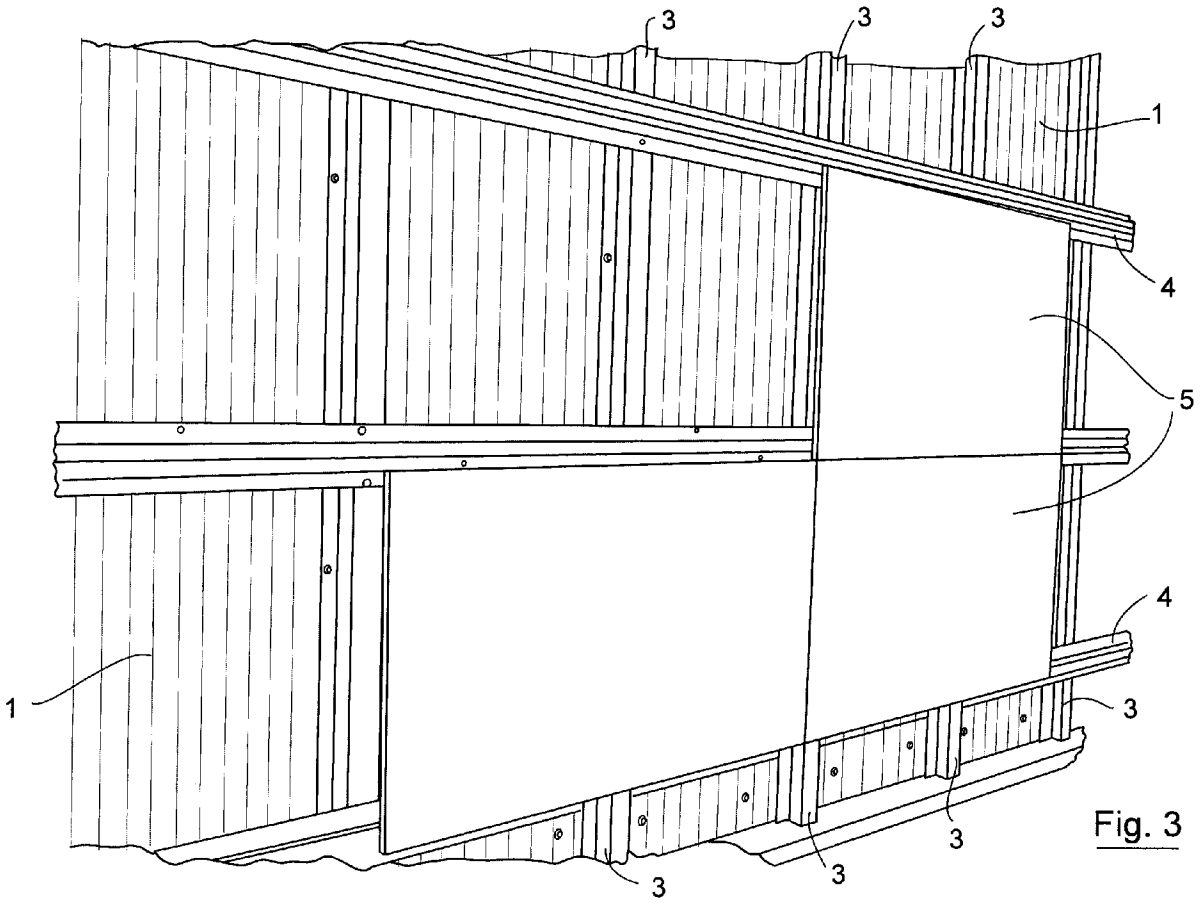
FIG. 3 is an enlarged perspective view of part of the wall system of FIG. 2.
Figure 4:
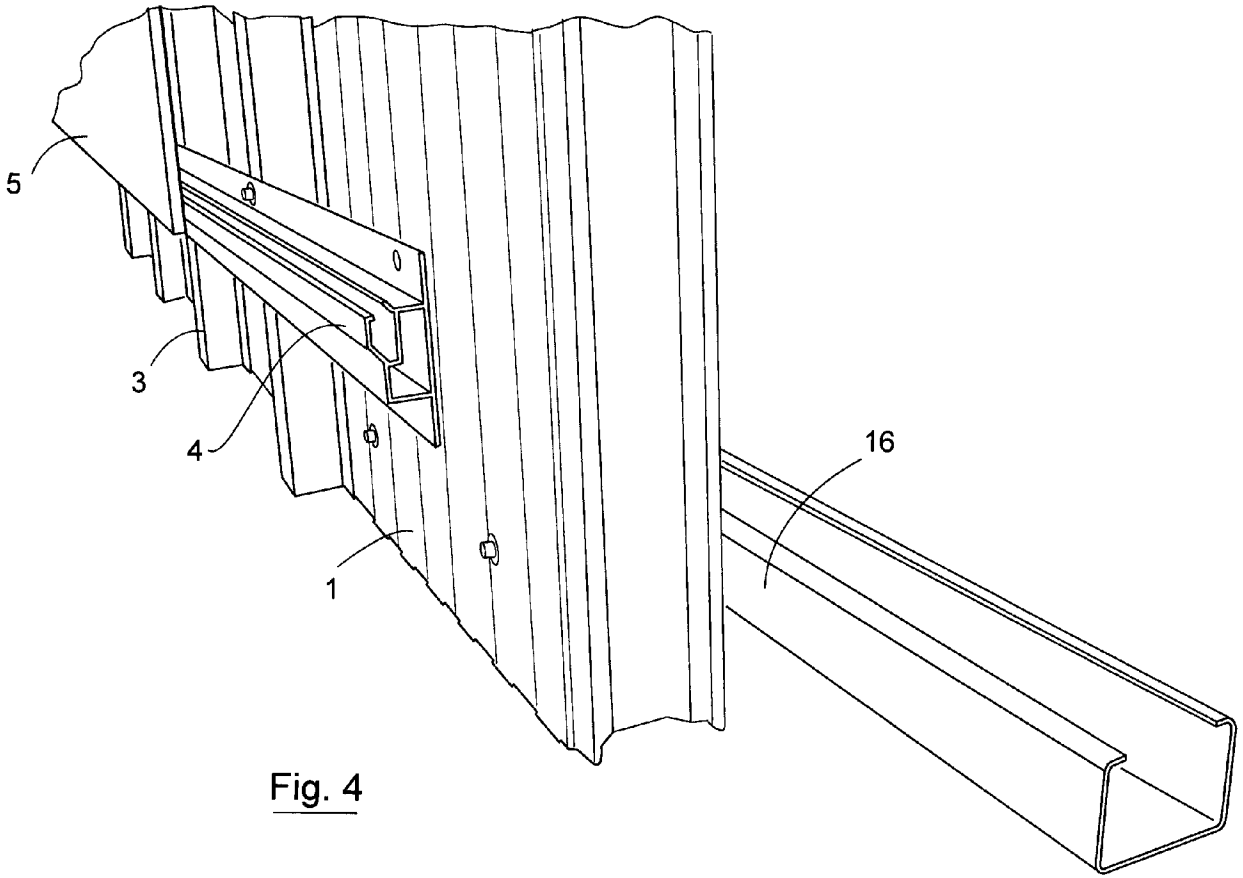
FIG. 4 is an enlarged perspective view of a corner detail of the wall system.

FIG. 3 is an enlarged perspective view of part of the wall system of FIG. 2 and FIG. 4 is an enlarged perspective view of a corner detail of the wall system.

Similarly, on the inside face of the panels 1, top hat sections 3 are used to bridge and reinforce the internal joints 2 between adjacent panels. The top hat section provides a flat part to which the plasterboard 10 is mounted using the fixings 11.

The structural infill wall panel system of the invention provides structural, fire, thermal and weather-ability performance. A range of external façades may be mounted to the panel modules. The internal and external top hat sections in combination with the panels provides stiffness and diaphragm action. The system of the invention uses composite insulating panels in a revolutionary way. There is no need for secondary support steelwork to support the panels. The individual panels in a module act as a single monolithic structure forming a diaphragm and allowing gravity loads to be distributed to a building. The system undergoes very small deflection under wind loading and is sufficiently stiff to support an external facade and a brittle internal façade such as plasterboard.

The insulation panels used in the invention may be provided in any suitable width, typically in the range 600 mm to 1200 mm to meet any elevation arrangement of heights and openings. The panel thickness is selected to achieve any thermal or load/deflection requirements. Such thicknesses include 50, 80, 100, 125, 150, 175, 200, 225 mm.

The top hat sections 3 are particularly useful as they allow the joints between the panels to be readily straddled to provide diaphragm action. Adjacent external top hat sections define a cavity for ventilated facades and on the internal face of the panels the space between the top-hat sections 3 defines a cavity for services.

The panels provide an air tight weather proof joint that can be left exposed for later fitting of a façade.

Referring to FIGS. 7 to 13 there is illustrated another wall façade module system 50 according to the invention which is similar to the system of FIGS. 1 to 6 and like parts are assigned the same reference numerals. This system incorporates an opening 51 and a framing system 52 is used to define the opening. A standardised framing method is used to cater for any opening size and wind loads. The framing system is designed and tested for maximum wind load resistance.

Figure 8:
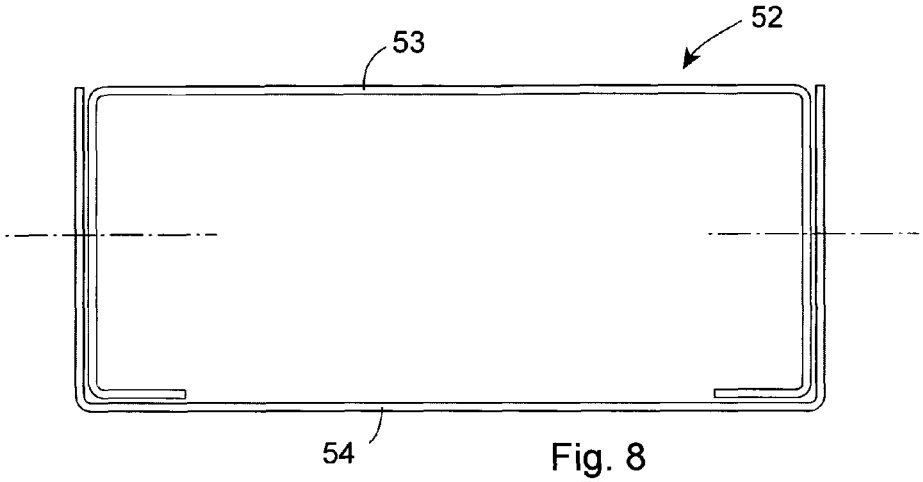
FIG. 8 is a cross sectional view of assembled frame-forming members.
Figure 9:
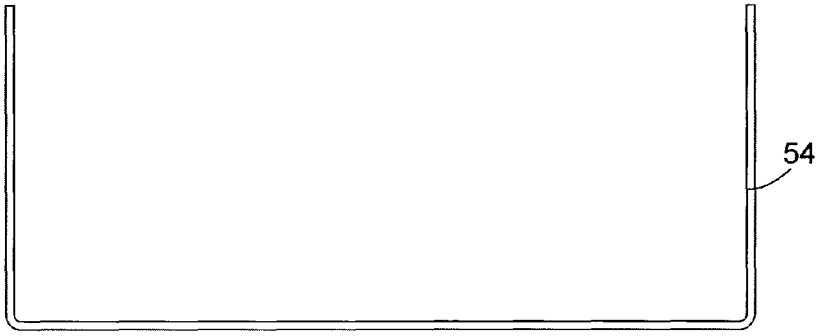
FIG. 9 is a cross sectional view of a channel section frame member of the assembly of FIG. 8.
Figure 10:
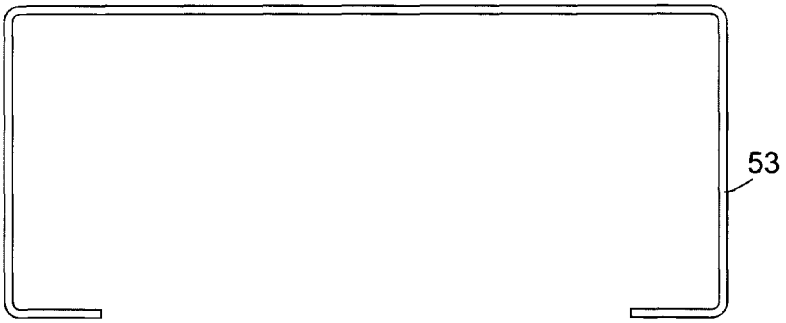
FIG. 10 is a cross sectional view of a C-section frame member of the assembly of FIG. 8.
Figure 11:
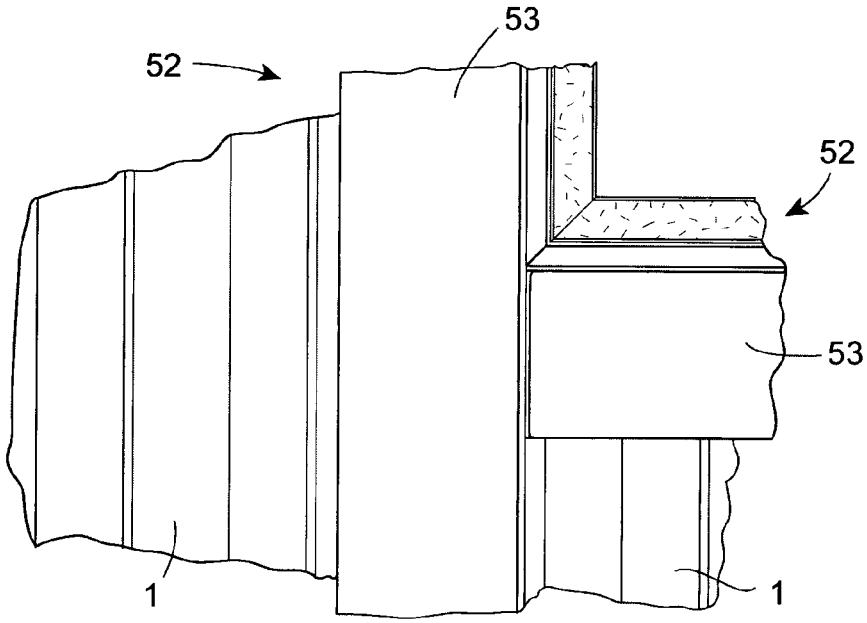
FIG. 11 is an enlarged detail view of a window framing horizontal/vertical joint.
Figure 12:
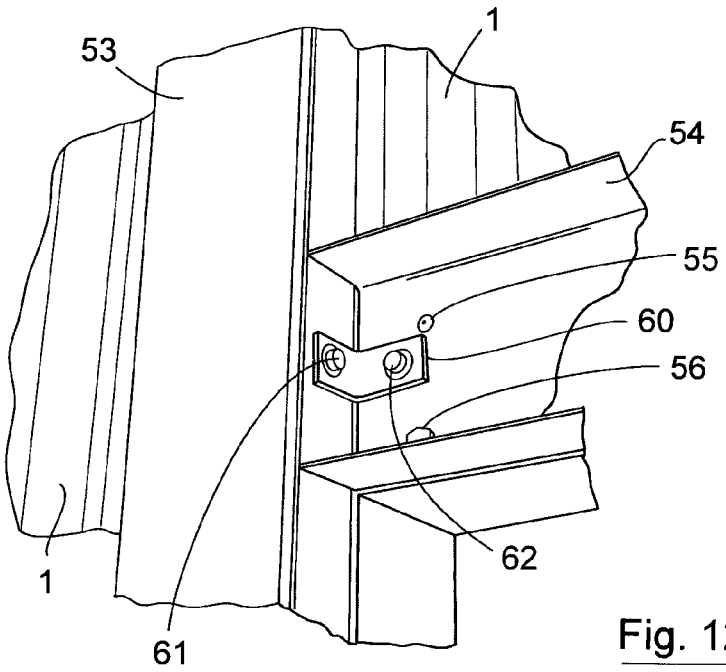
FIG. 12 is another view of the joint of FIG. 11 with one of the frame members removed to expose a bracket fixing for joining the window frame horizontal/vertical sections.
Figure 13A:
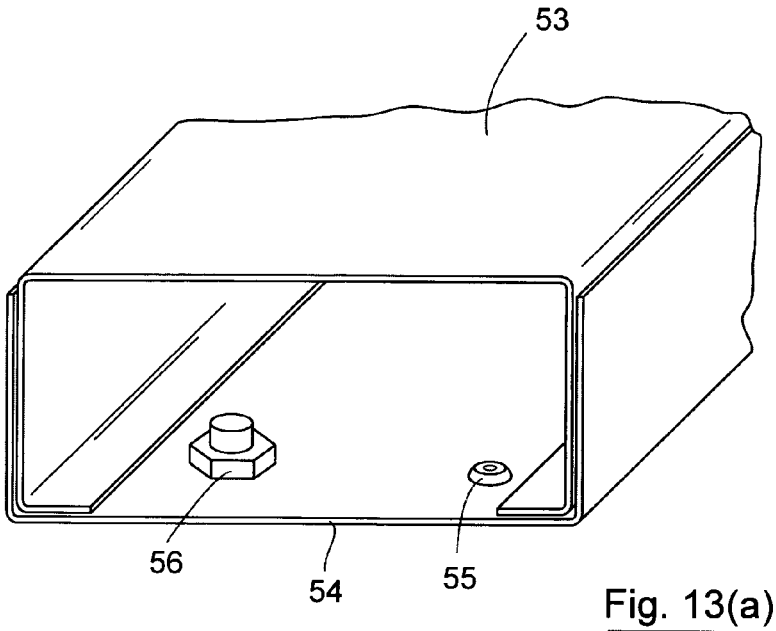
FIG. 13(*a*) is a perspective view illustrating one window frame fixing arrangement.
Figure 13B:
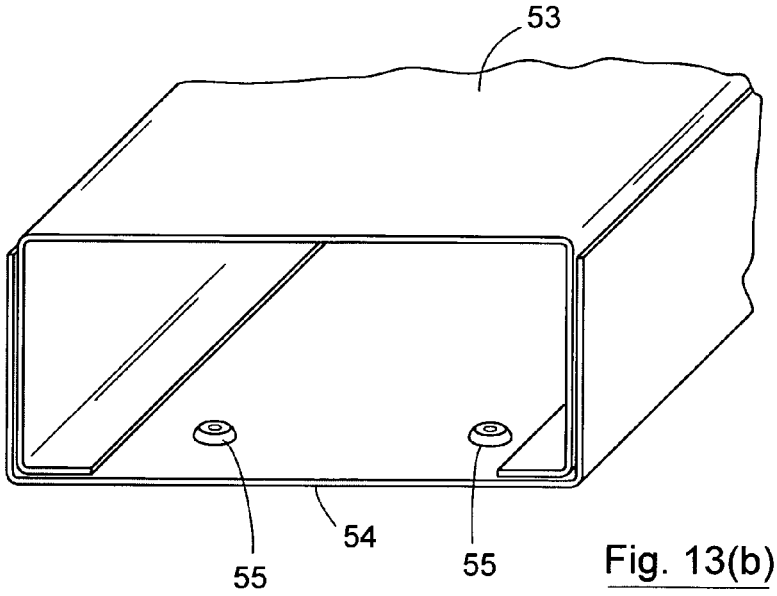

The framing system 52 comprises a channel section frame member 54 and a C-section frame member 53 which are interengagable together as illustrated in FIG. 8 to form a particularly strong frame assembly. The framing system 52 is readily mounted to the underlying panel 1 using suitable fixings 55, 56. The joint between horizontal and vertical framing systems is illustrated in FIGS. 11 and 12. An L-shaped bracket 60 is used to interconnect the frame members of adjacent framing systems 52. Fixings 61, 62 are used to mount the bracket 60 to the adjacent frame members.

On assembly, the C-section frame elements 53 are fitted into the channel frame elements 54 and the frame elements 53, 54 are fixed together using rivets along the sides thereof.

Figure 7:
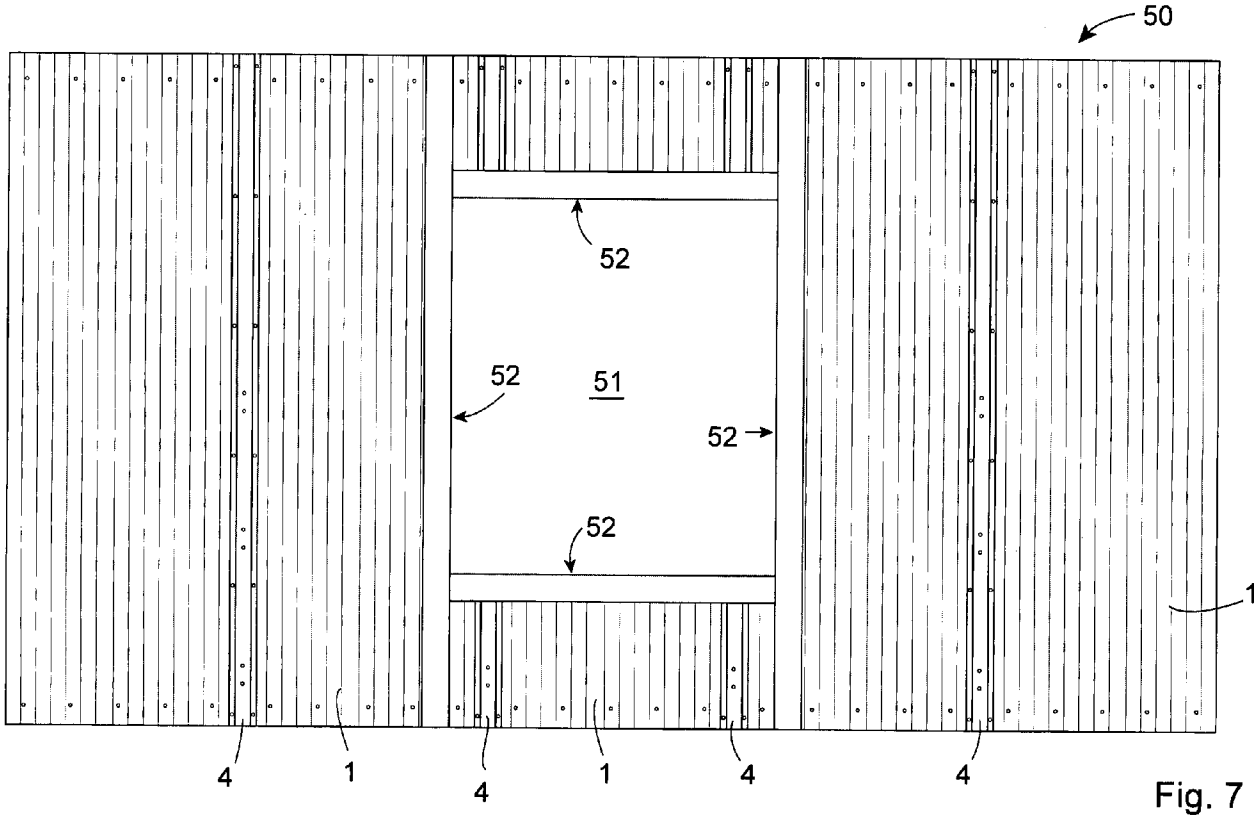
FIG. 7 is a front elevational view of another panel system according to the invention including an opening for a window.

For enhanced structural strength and load transfer the vertical frame systems may extend beyond the opening 51 to the full height of the panels 1 (see FIG. 7).

Figure 14:
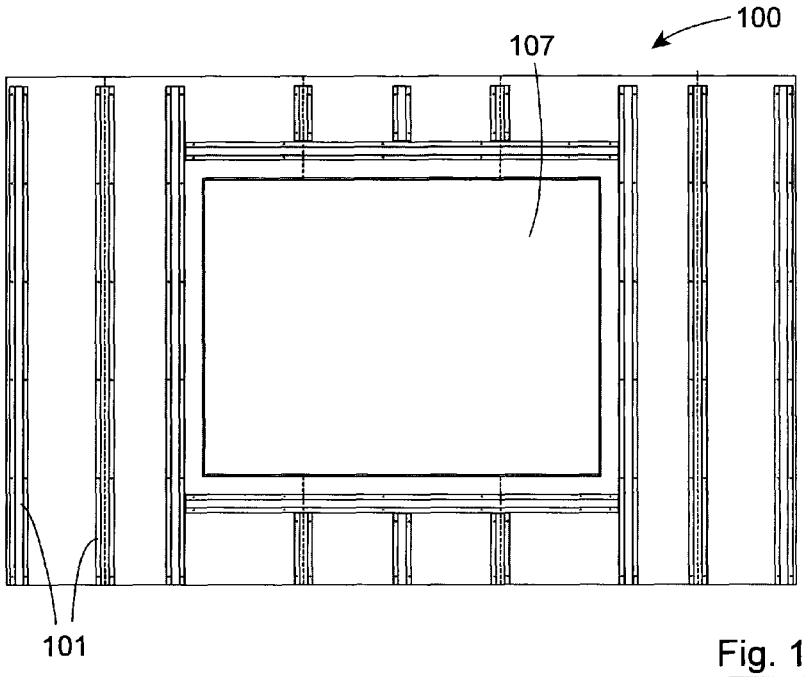
FIG. 14 is an elevational view of the external side of a module of a façade system according to the invention.
Figure 15:
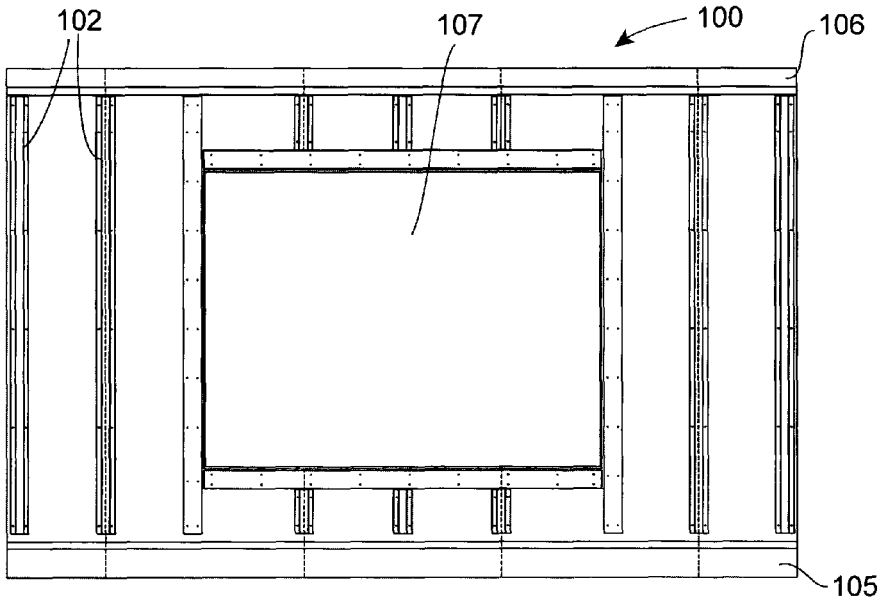
FIG. 15 is an elevational view of the internal side of the module of FIG. 14.

Referring to FIGS. 14 and 15 there is illustrated a typical module 100 according to the invention that may be used to construct a building. External top-hat sections 101 are shown in FIG. 14 and internal top-hat sections 102 are shown in FIG. 15. The base support bracket is provided by a base U-shaped support member 105 and a head support bracket is provided by a top U-shaped support member 106. In this case the module 1 has a rectilinear opening 107 for a window.

Figure 16:
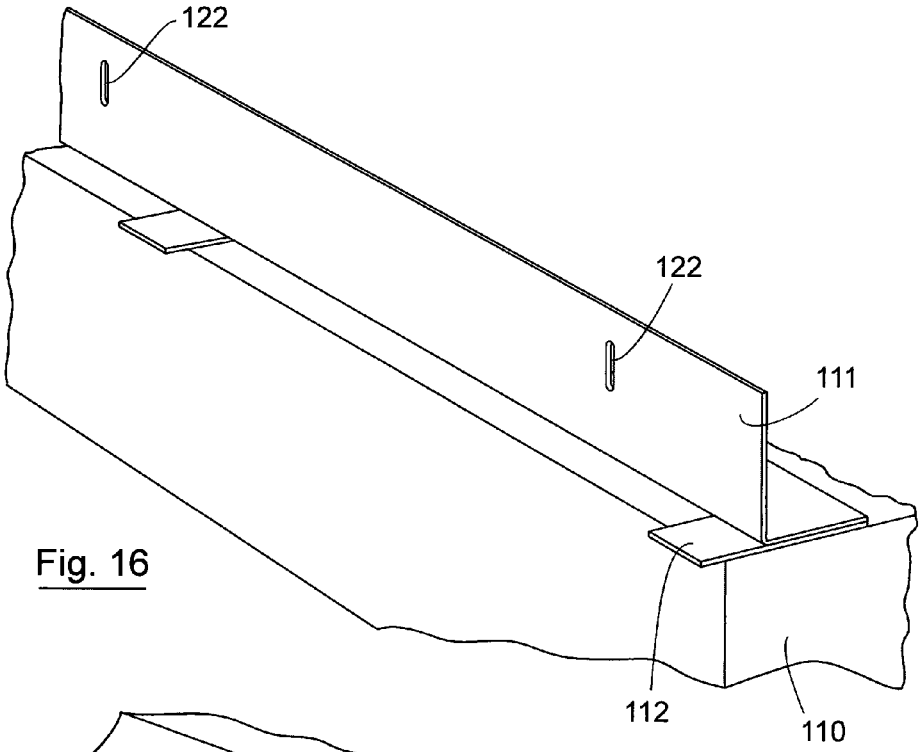
FIG. 16 is a perspective view of a base support for receiving a module of FIGS. 14 and 15.
Figure 17:
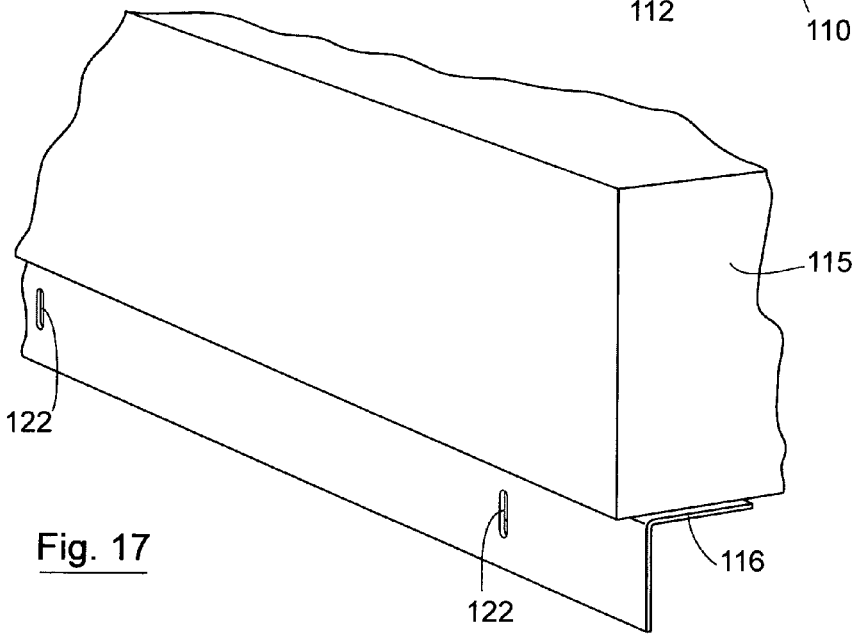
FIG. 17 is a perspective view of a head support for receiving the module.

The module 100 is mounted to a base slab 110 of a building using an angle bracket 111 which is illustrated in FIG. 16 with levelling shims 112 in place. The module 100 is also mounted to a head slab 115 using an angle bracket 116 as illustrated in FIG. 17.

Figure 18:
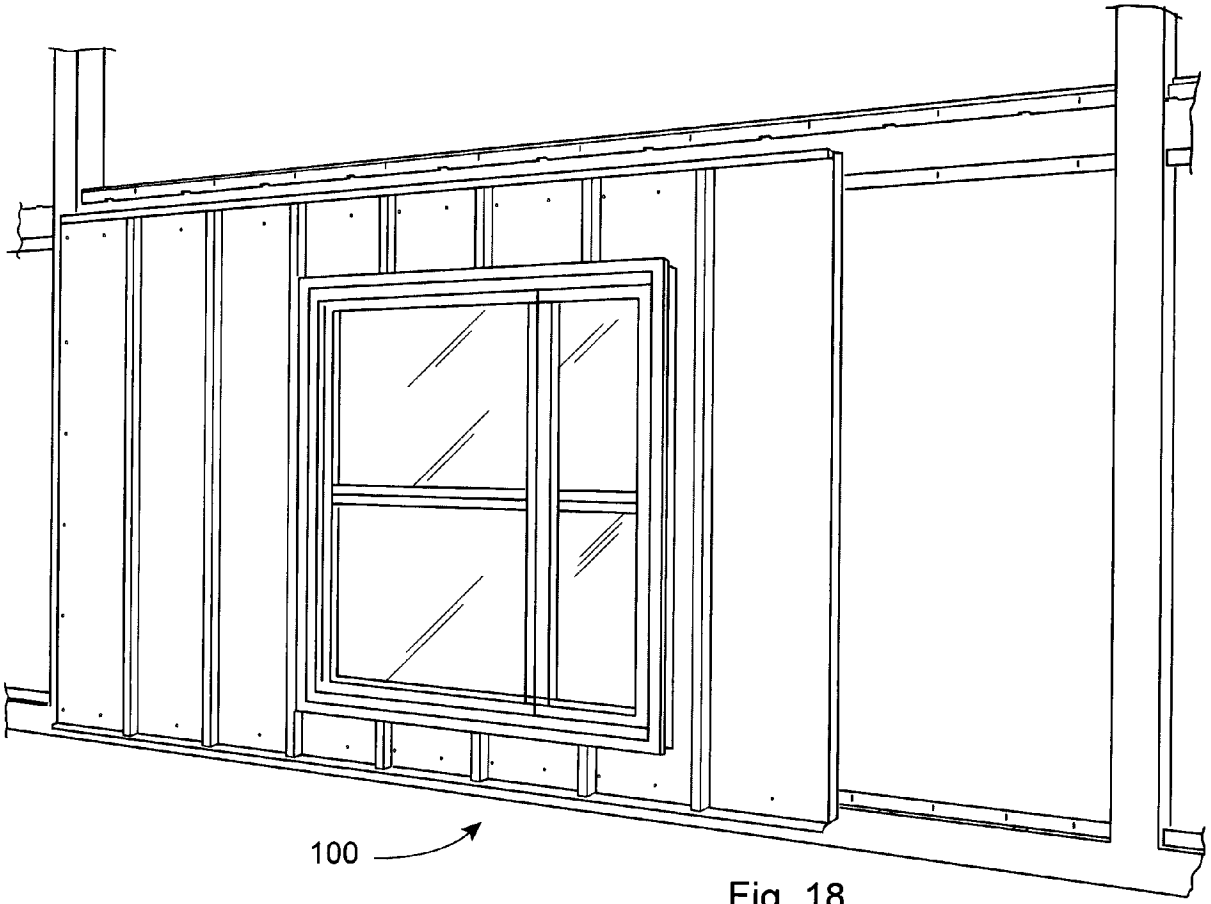
FIG. 18 is a perspective view of a first module mounted to a framework.
Figure 19:
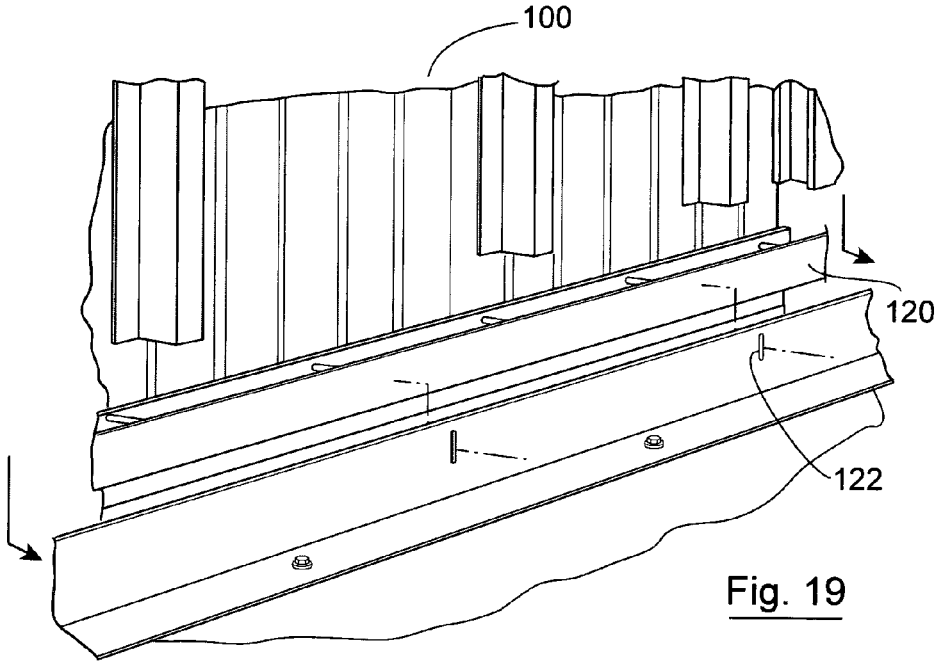
FIGS. 19 and 20 are perspective views illustrating the mounting of a module for an angle support member.
Figure 20:
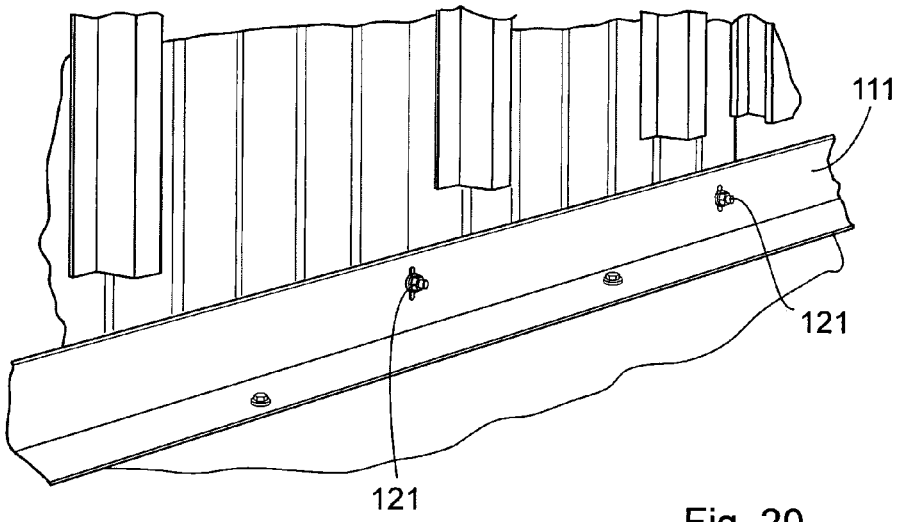

A first module 100 being installed is shown in FIG. 18. FIGS. 19 and 20 illustrate the mounting of the module 100 to the angle bracket base support 111. A U-section base bracket 120 of the module is positioned with respect to the angle 111 and mounting nuts 121 extending through holes 122 in the angle 11 are used to secure the module 100 to the mounting angle 111.

Figure 21:
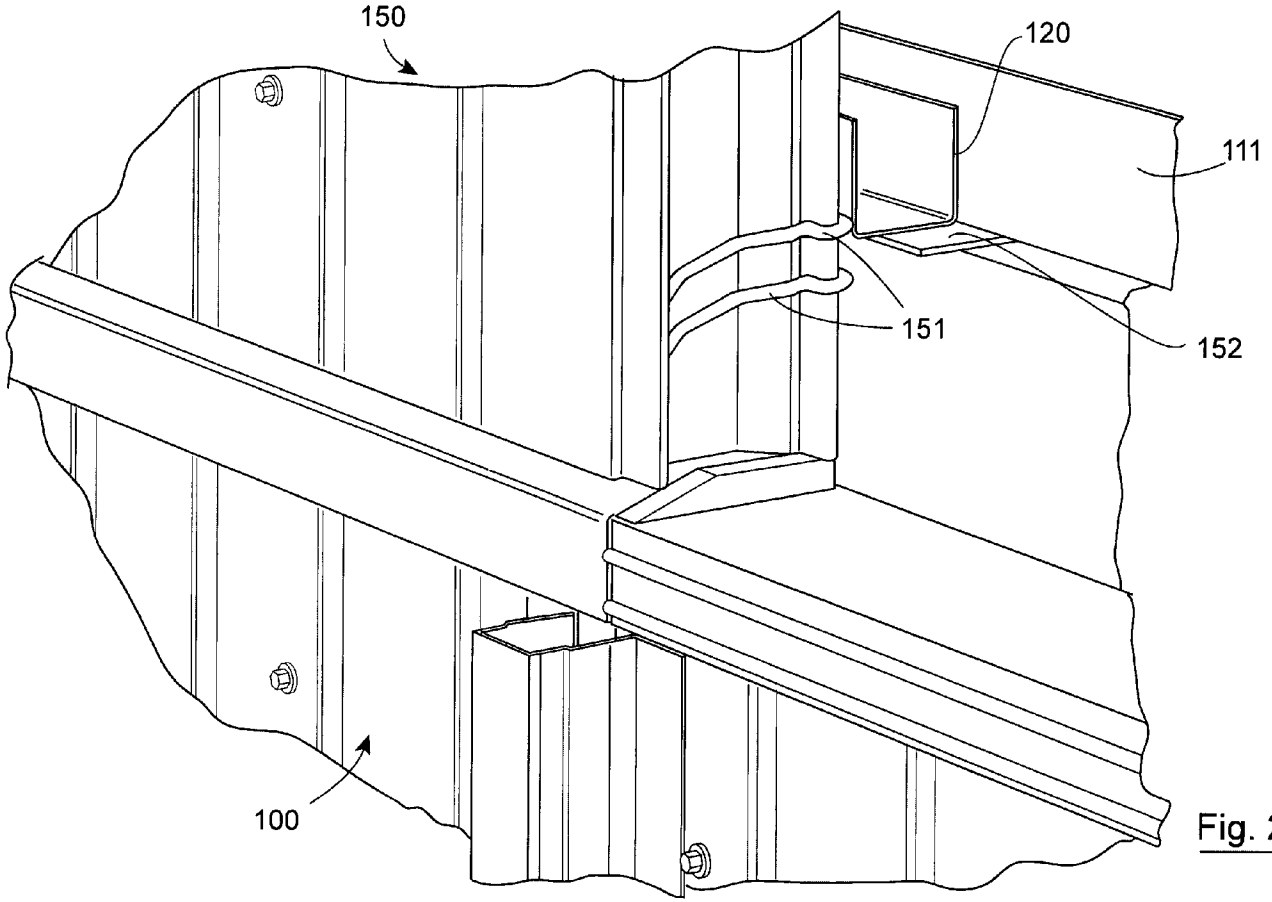
FIG. 21 illustrates the mounting of another module above a lower module.

Referring to FIG. 21 an upper module 150 is illustrated being positioned above a lower module 100. Levelling shims 152 are used to level the upper module 150. Beads 151 of a sealant such as an EPDM sealant are used for sealing to the lower module.

Figure 22:
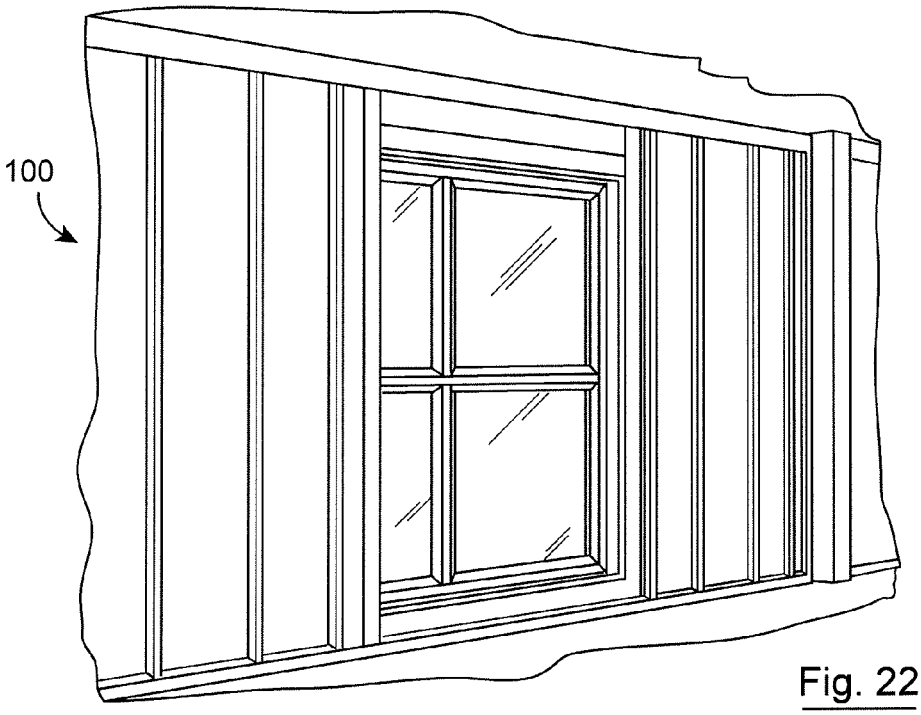
FIG. 22 is a perspective internal view of a module.
Figure 23:
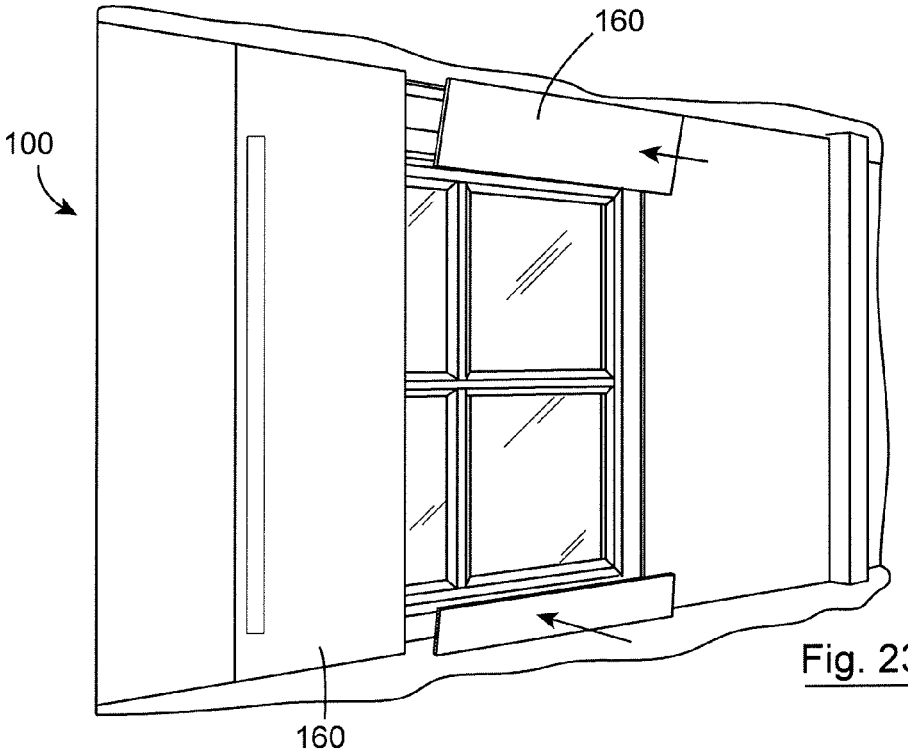
FIG. 23 is an internal view with internal cladding being installed.

FIGS. 22 and 23 illustrate internal cladding such as plasterboard 160 being applied to the inside of the module 100.

Figure 24:
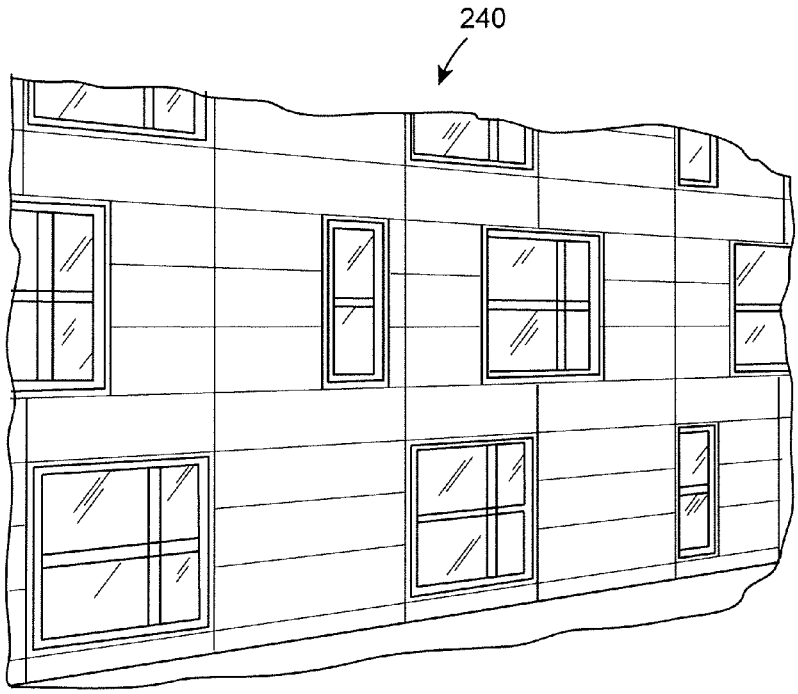
FIG. 24 is a view of a finished building comprising a plurality of modules.
Figure 25:
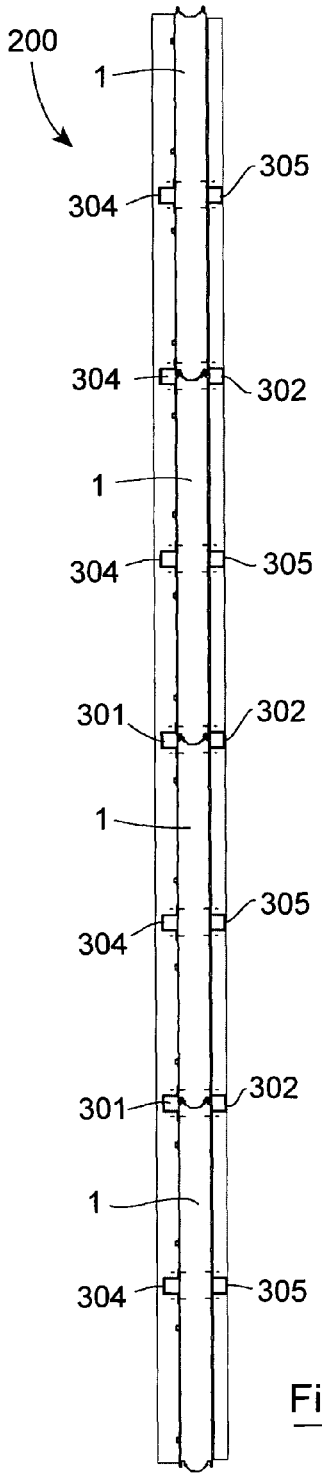
FIG. 25 is a top plan view of a structural infill panel module according to the invention.
Figure 26:
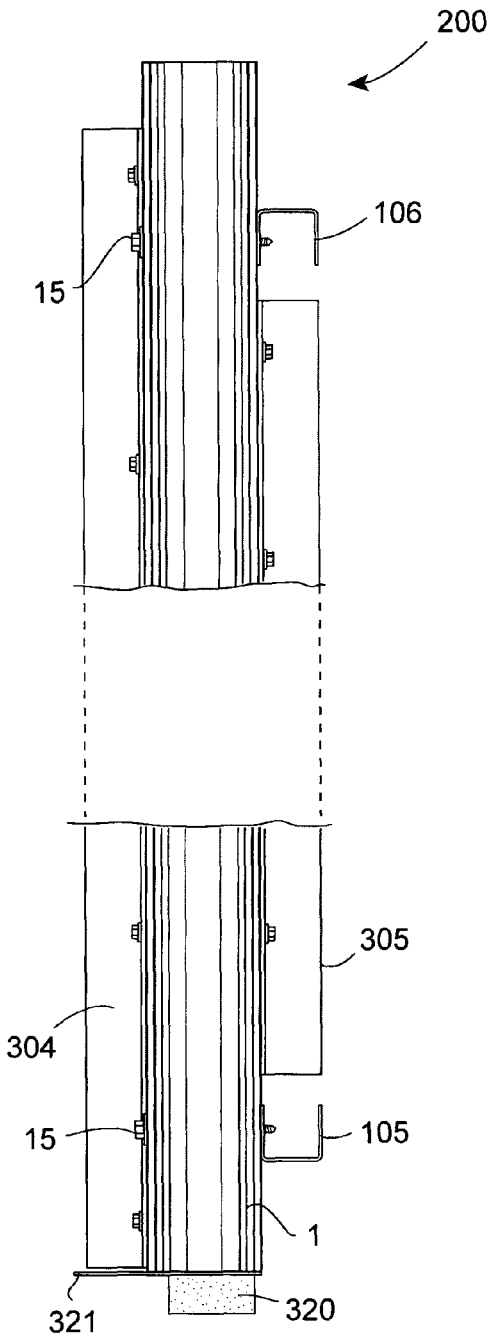
FIG. 26 is an end elevational view of the module of FIG. 25.

FIG. 24 illustrates a finished building 240 incorporating a plurality of modules according to the invention.

In more detail and referring initially to FIGS. 25 to 28 a typical structural infill wall panel module 200 is illustrated. The module in this case comprises four insulating panels 1 with reinforcing top hat sections 301, 302 bridging the joints between the panels on both the external and internal faces of the panels. Additional reinforcing elements 304 are in this case provided mid-way across the width of the external sheet of each panel 1. In this case the external additional reinforcing elements 304 are also of top hat profile. In this case additional reinforcing elements 305 are also provided mid-way across the width of the internal sheet of each panel and in this instance the internal additional reinforcing elements are also of top hat profile. This arrangement is particularly advantageous in ensuring that the panels 1 in each module are integrated into a single monolithic structure while providing a flat raised surface to which external rails and/or cladding can be mounted while providing a ventilation gap between the cladding and the face of the external sheet of the panel. Similarly, the internal top wall sections provide a raised flat surface to which a suitable internal cladding such as plaster board sheets can be readily mounted while leaving a gap between the internal face of the panel and the internal cladding which can be used for services ducts and the like.

Figure 27A:
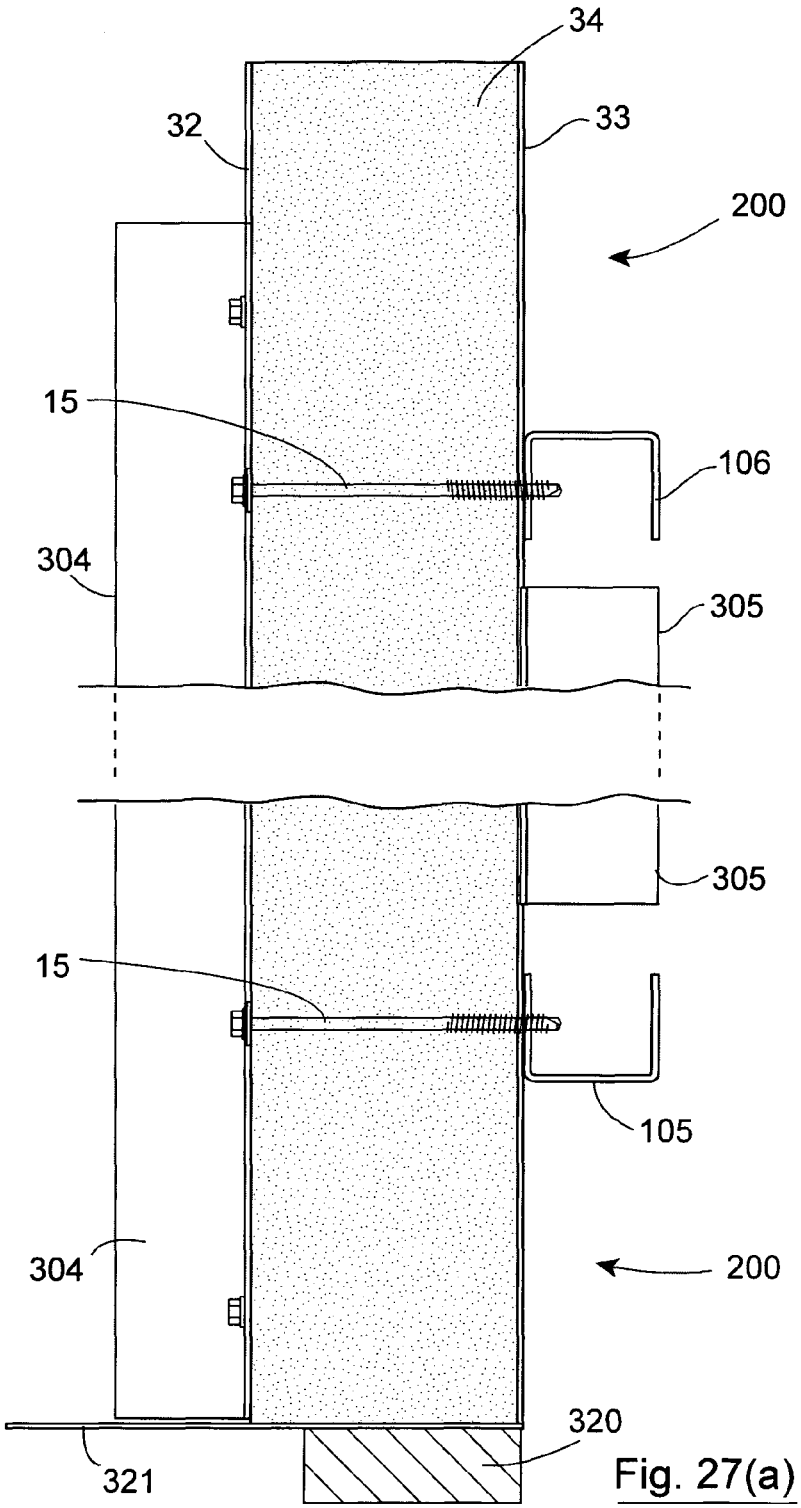
FIG. 27 (*a*) is a longitudinal cross sectional view of the module of FIGS. 25 and 26.
Figures 27B, 27C:
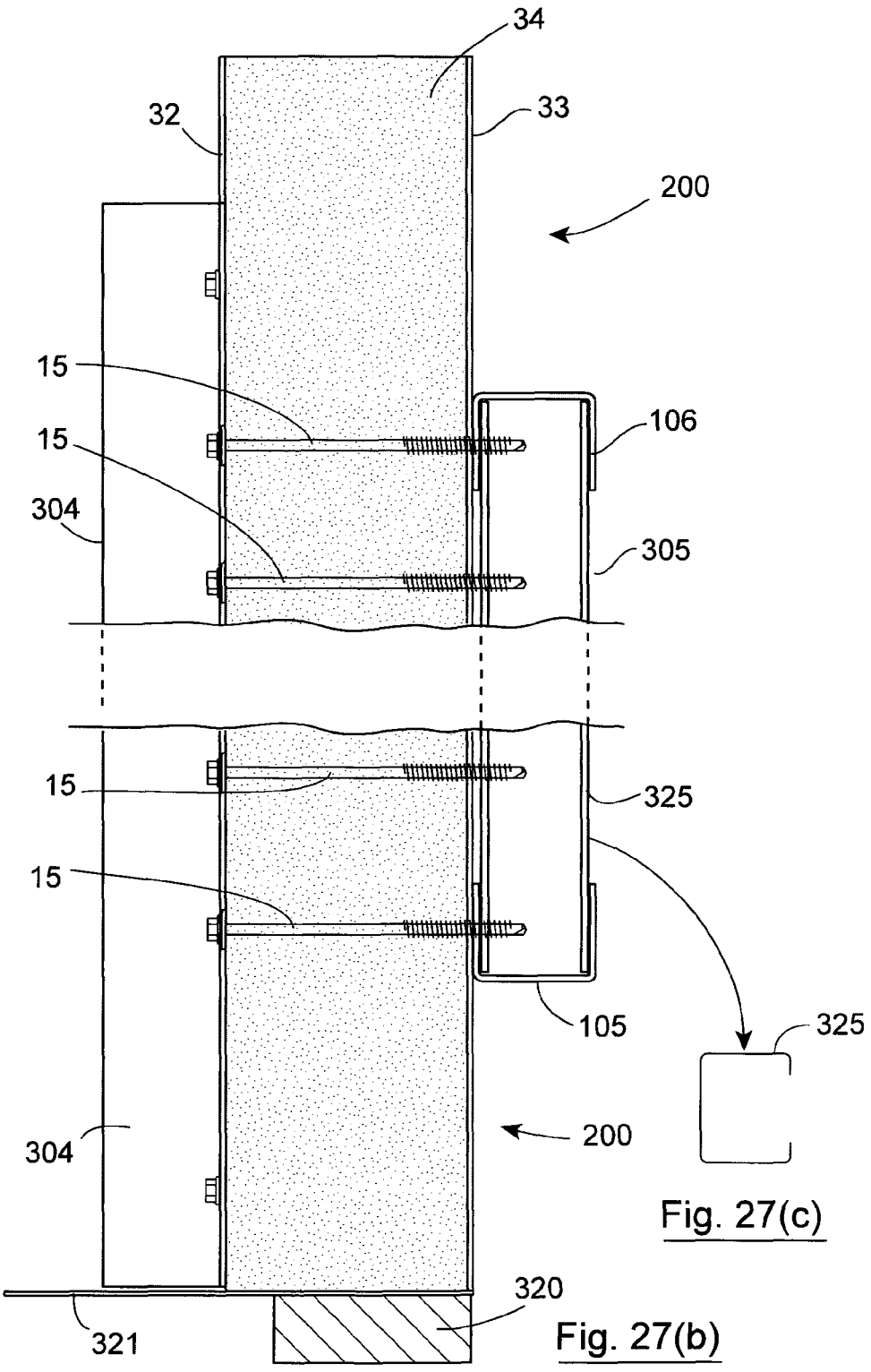
Figure 28:
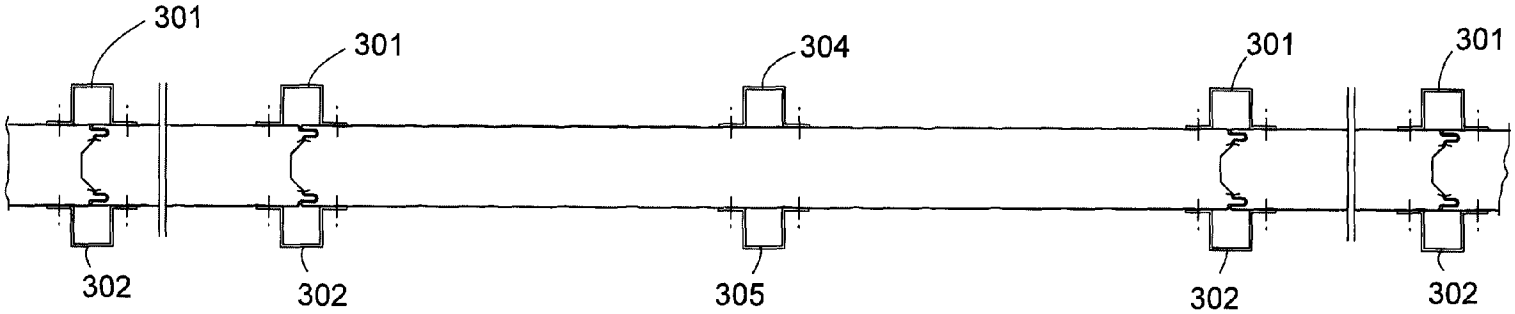
FIG. 28 is a top plan view of the module of FIGS. 25 to 27 on an enlarged scale.

Referring to FIGS. 27(*b*) and 27(*c*) a longitudinal/vertical member such as a C-section profile 325 may extend between the head and base supports 105, 106 where the vertical columns of the building are positioned. Further fixings 15 may be fixed through the panel to the C-section profile to assist in load transfer. The fixings 15 may be applied through the panel to the C-section at any required vertical spacing such as about 600 mm. Such a vertical member may be applied in the factory where the module is manufactured. The vertical member may be fixed to a building column on site from the inside of the building. The fixings 15 which are used to fix the panel to the support brackets (and in this case also to the vertical support 325) are inserted in the factory during manufacture of the panel module and extend through the panel and into the supports 105,106 and in this case are also extended through the panel and into the vertical support 325. Thus the panel is fixed from the outside or external panel sheet through to internal supports. The internal supports in turn can be readily accessed from the inside of the building during on site assemble to facilitate quick and easy mounting to a building from the inside.

Figure 29:
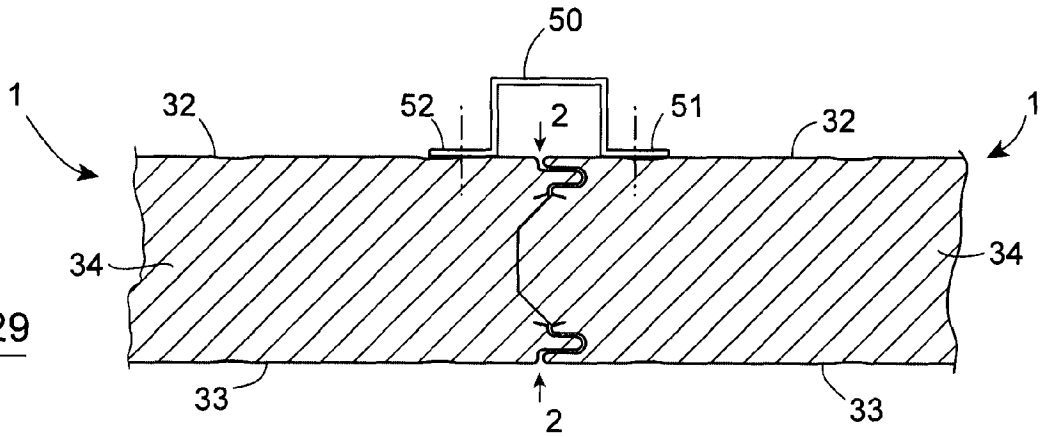
FIG. 29 is a cross sectional view of a joint detail between adjacent insulating panels.
Figure 30:
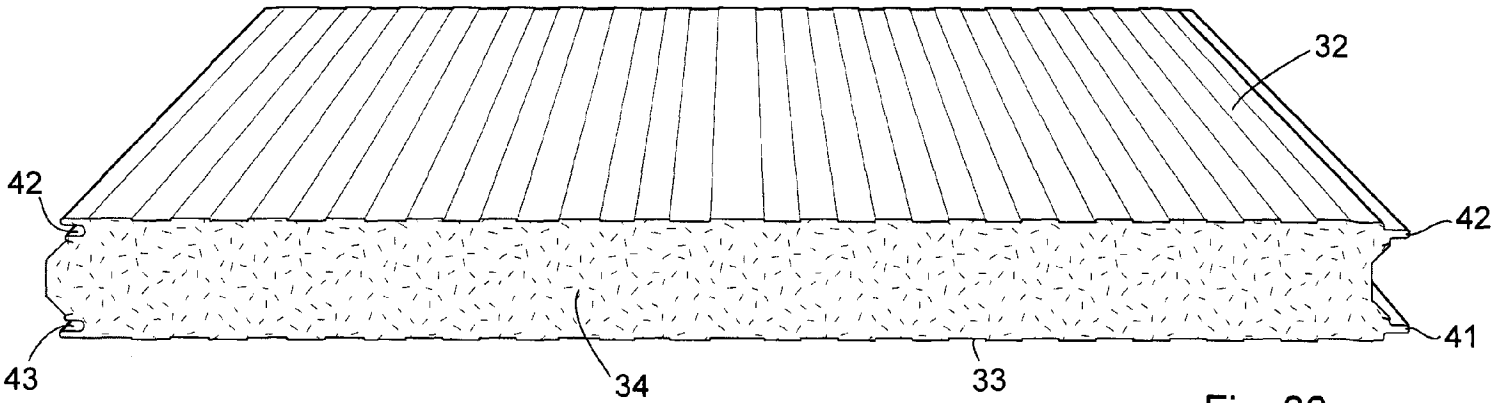
FIG. 30 is a perspective view of a typical panel of the module.

FIGS. 29 and 30 illustrate an alternative panel joint detail which is similar to that described above with reference to FIGS. 5 and 6 and like parts are assigned the same reference numerals.

The base support 105 and the head support 106 are visible particularly in FIG. 27. It will be noted that the internal reinforcing top hat elements 305 and 302 are shortened to accommodate the base and head supports 105, 106. A sealing system may be provided at a lower end of the panel module. The sealing system comprises a flexible seal 320 which may, for example, be of an open cell foam type material and a membrane part 321 of EPDM or the like which can be folded down over a joint between upper and lower modules.

Figure 31:
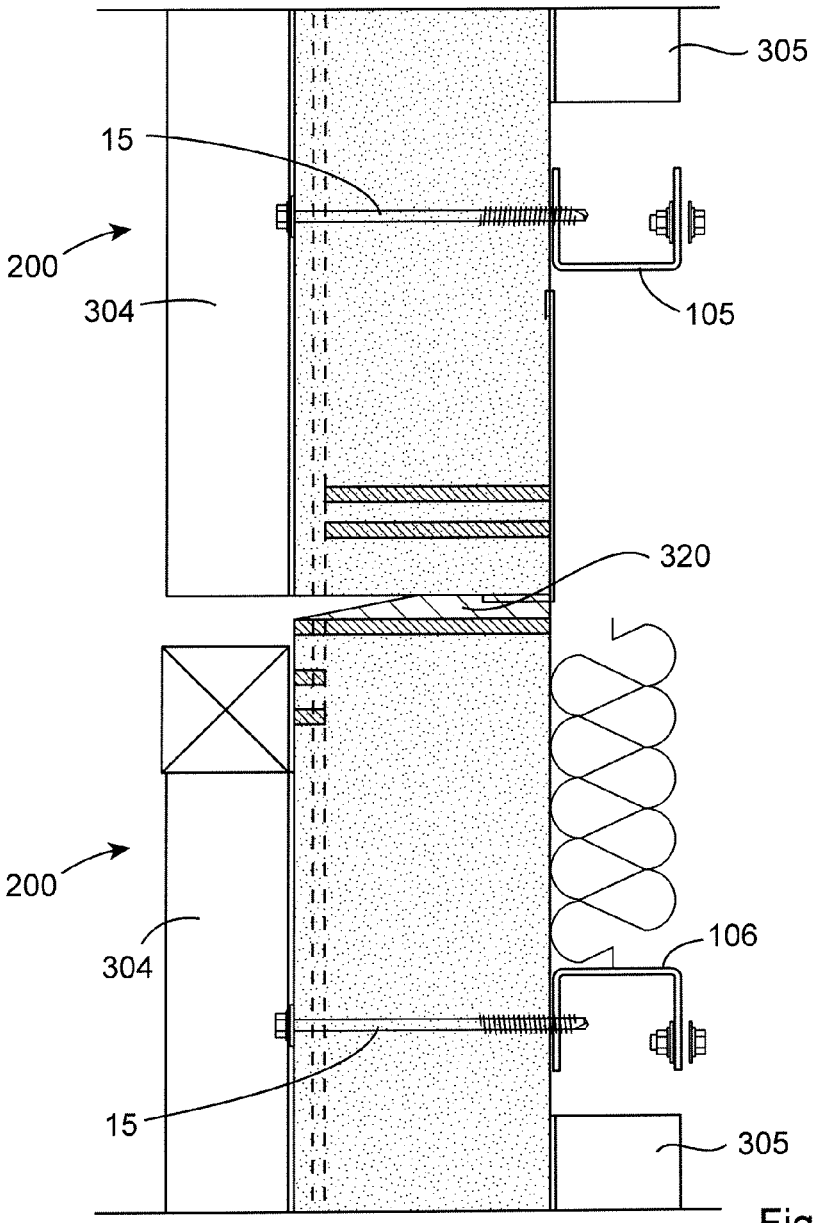
FIG. 31 is a cross sectional view of a joint detail between upper and lower modules.
Figure 32:
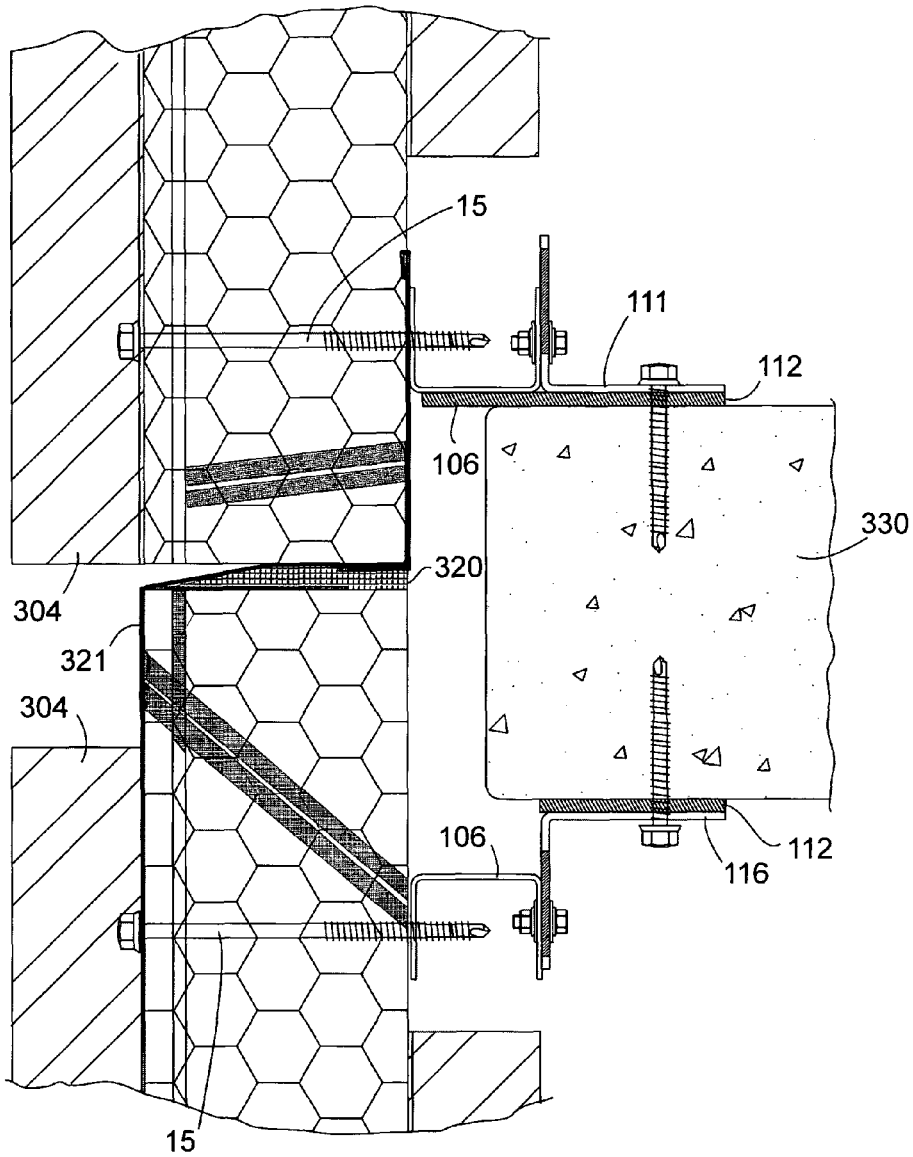
FIG. 32 is a cross sectional view of two modules attached to a building.
Figure 33:
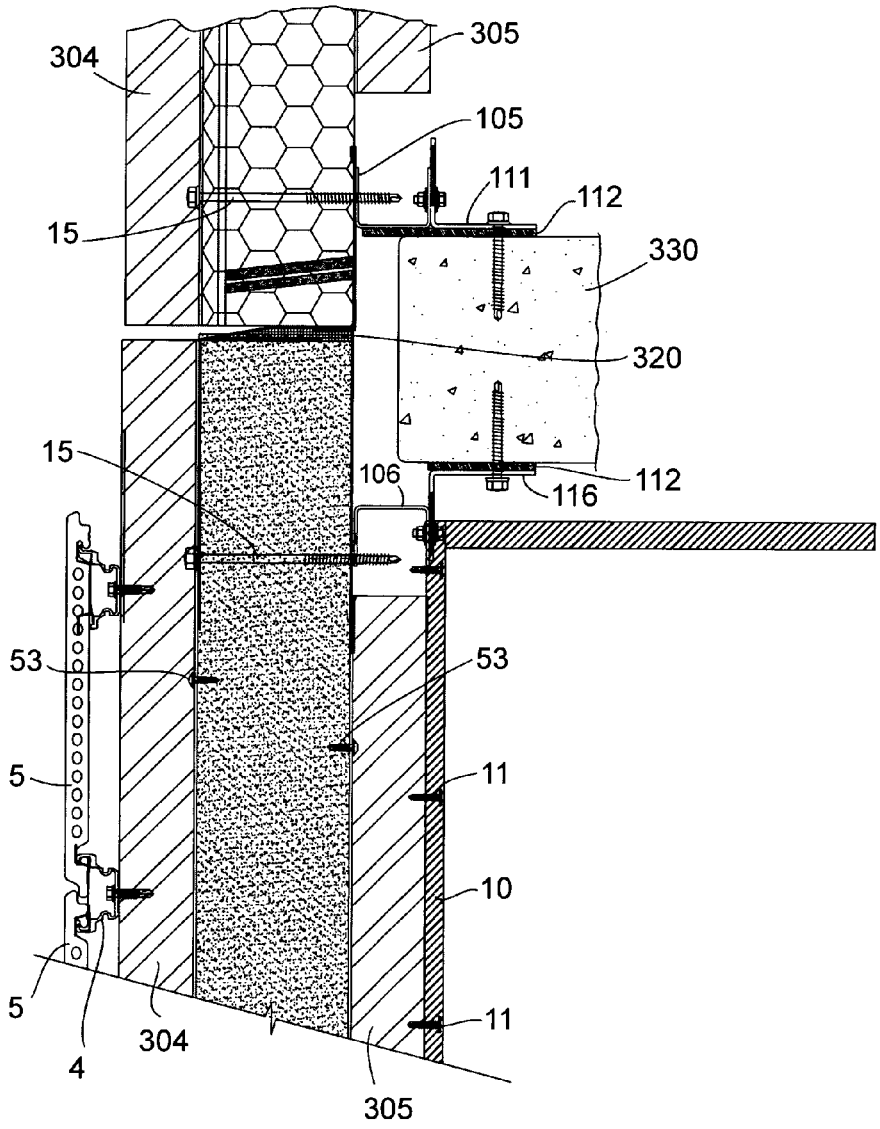
FIG. 33 is a cross sectional view similar to FIG. 32 with external and internal cladding elements in place.

FIGS. 31 to 33 show two like modules 200 mounted one above the other. The fixings used to fix the base support 105 and the head support 106 to the panels are visible in these cross sections. Also illustrated are base brackets 111 and head brackets 116 fixed to a building element such as a floor slab 330 and the levelling shims 112 between the brackets 111 and 116 and the slab 330. The base support 105 of the upper panel module is mounted to the base bracket 111 to fix the upper panel module to the base slab. Similarly the head support 106 of the lower panel module is mounted to the head bracket 116 to fix the lower module to the slab 330. The upper and lower modules are thereby independent of one another. In this way, any deflection of the slab 330 caused by a load force is distributed to both the upper and lower modules. The compressible seal 320 accommodates any slight movement between the upper and lower modules if the slab 330 is subjected to a deflection force. The membrane 321 covers the flexible seal 320 and provides a weather proof joint between the upper and lower modules.

Figure 34:
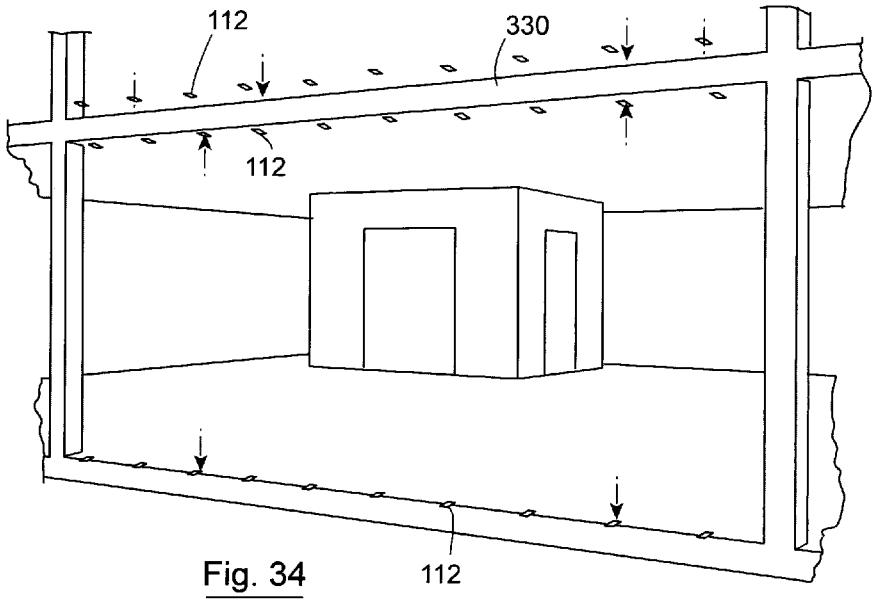
FIG. 34 is a perspective view of a building opening to which modules are to be attached.
Figure 35:
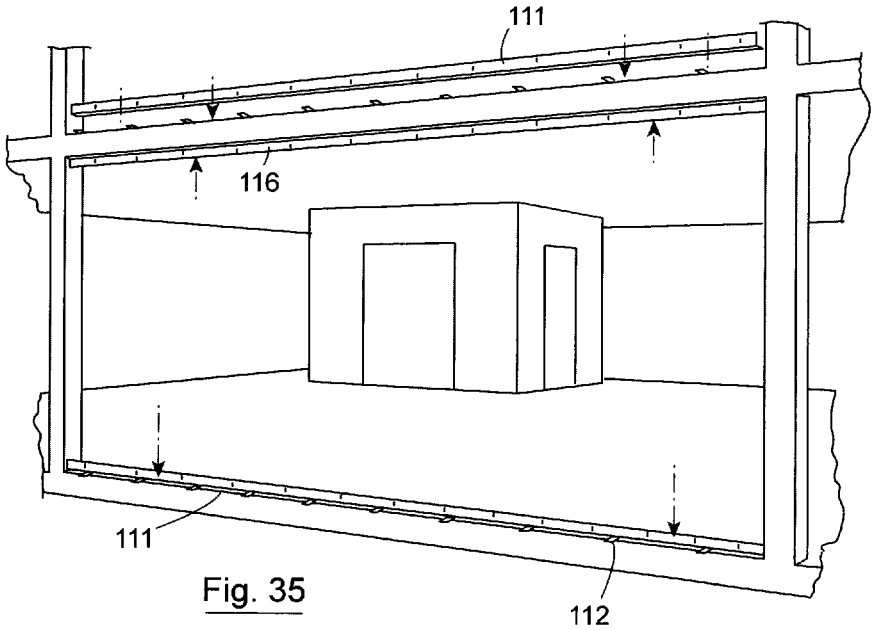
FIG. 35 is a view of the building of FIG. 34 with brackets being mounted in place to receive modules.
Figure 36:
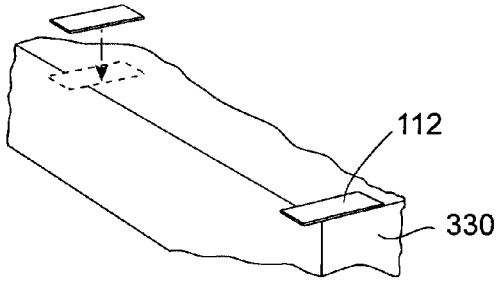
FIGS. 36 to 39 are enlarged perspective views illustrating shims and brackets being mounted to building elements.
Figure 37:
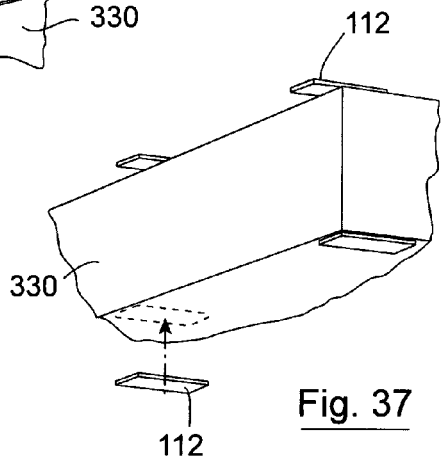
Figure 38:
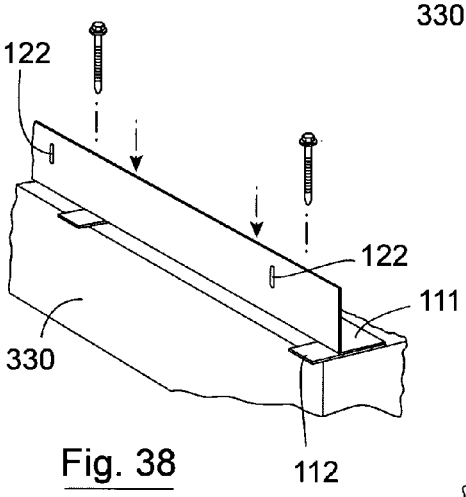
Figure 39:
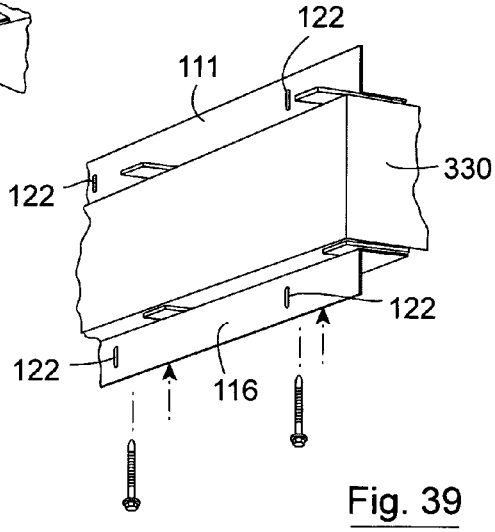

A typical building opening to which the modular panel system of the invention is to be mounted is shown in FIGS. 34 and 35. The mounting of the levelling shims 112 and the head brackets 116 and the base brackets 111 are also illustrated in FIGS. 36 to 39. As described above, the provision of the elongate slots 122 in both the base 111 and head brackets 116 accommodates any adjustment necessary to readily accommodate the fixing of the modules to the building slab 330.

Figure 40:
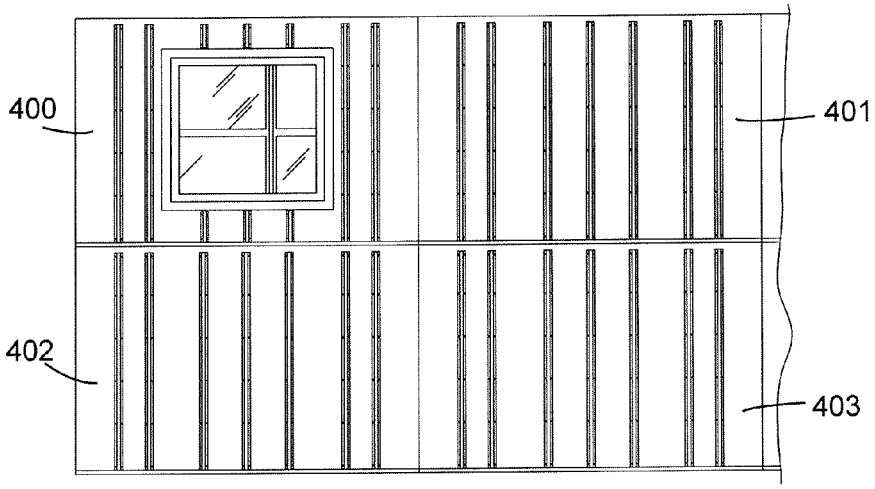
FIG. 40 is a front view of number of modules in situ.
Figure 41:
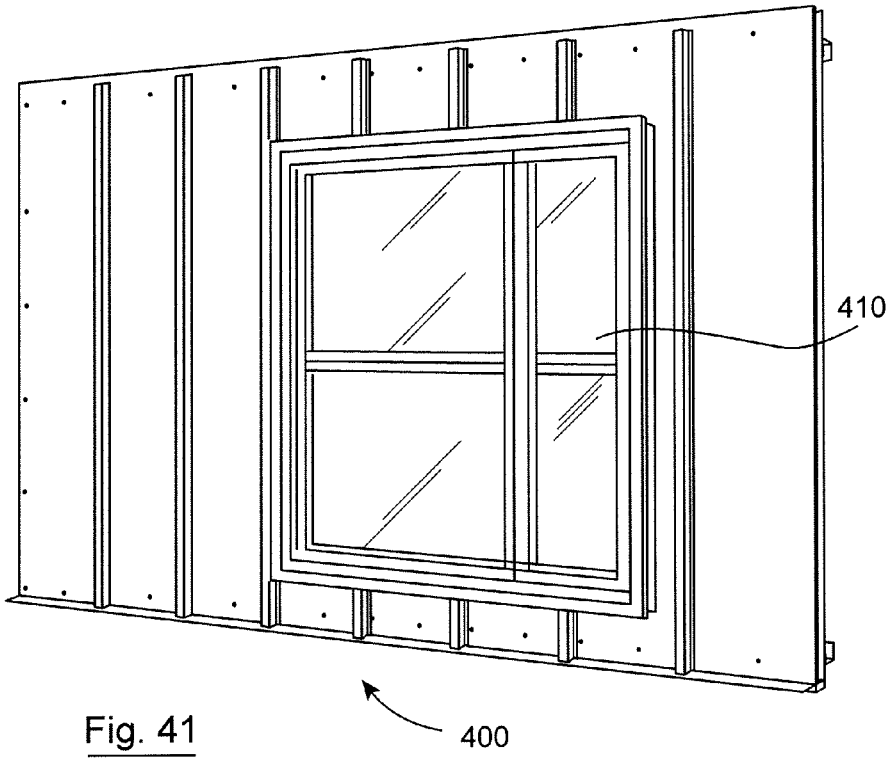
FIG. 41 is a perspective view of a typical building module.
Figure 42:
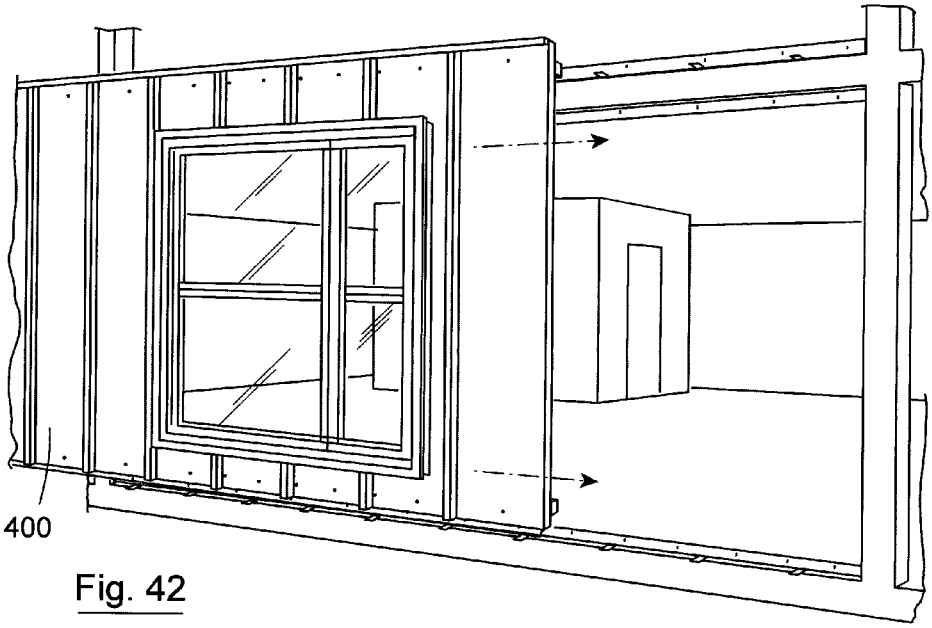
FIGS. 42 and 43 are perspective views of a module being mounted to building elements.
Figure 43:
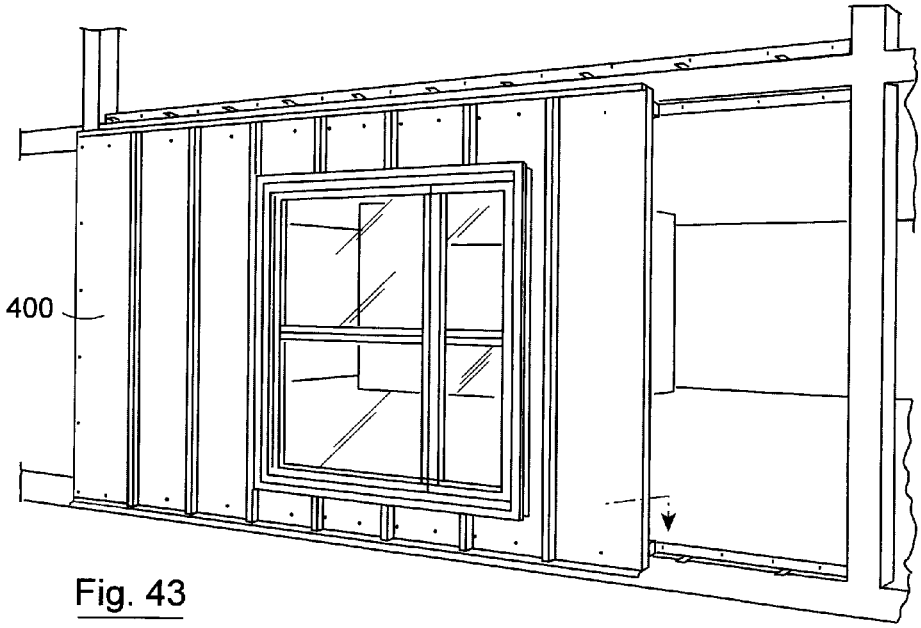
Figure 44:
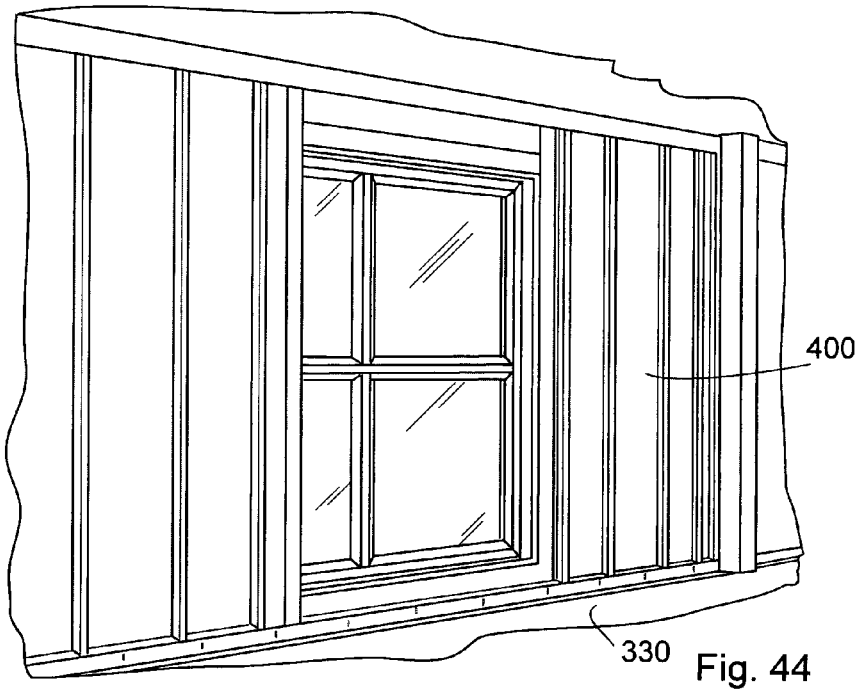
FIG. 44 is a perspective view from the inside of the building of the module.
Figure 45:
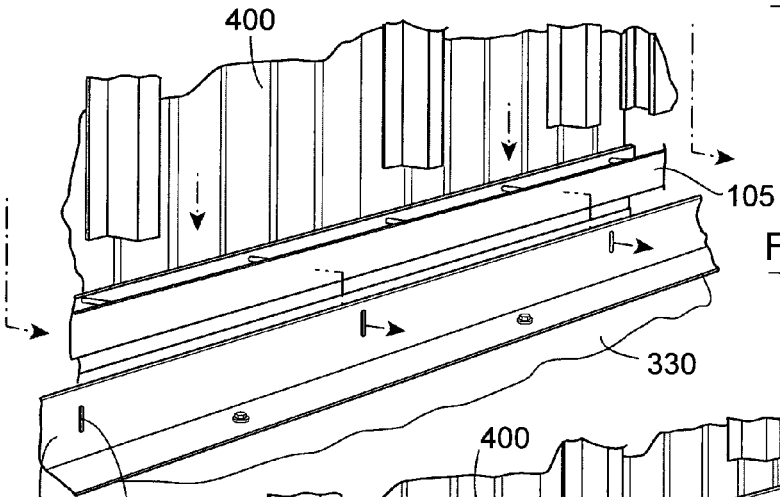
FIGS. 45 and 46 are perspective views from the inside of the building illustrating the mounting of the module to the mounting brackets.
Figure 46:
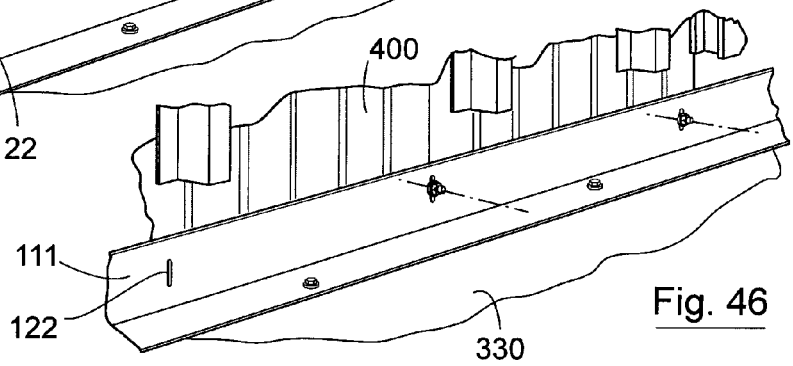

FIG. 40 illustrates a number of modules 400, 401, 402, 403 assembled together. FIG. 41 shows one of the modules 400 which in this case comprises a window 410. FIGS. 42 and 43 show the module 400 being manoeuvred into position relative to a building opening. FIG. 44 shows the module 400 from the inside of the building. FIGS. 45 and 46 illustrate the mounting of the module 400 to a base bracket 111.

Figure 47:
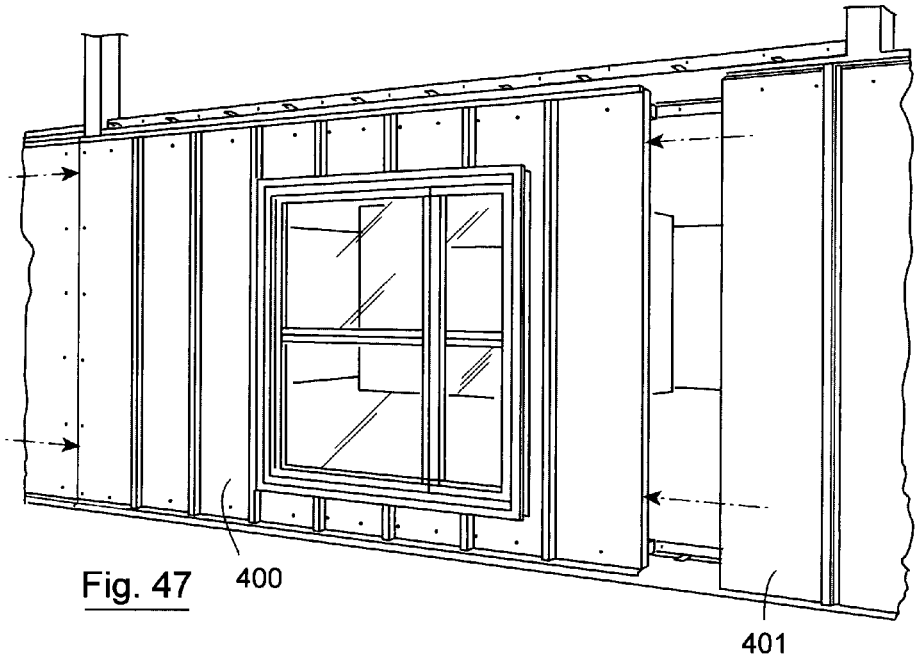
FIG. 47 is an isometric view illustrating the mounting of a second module to a first module.
Figure 48:
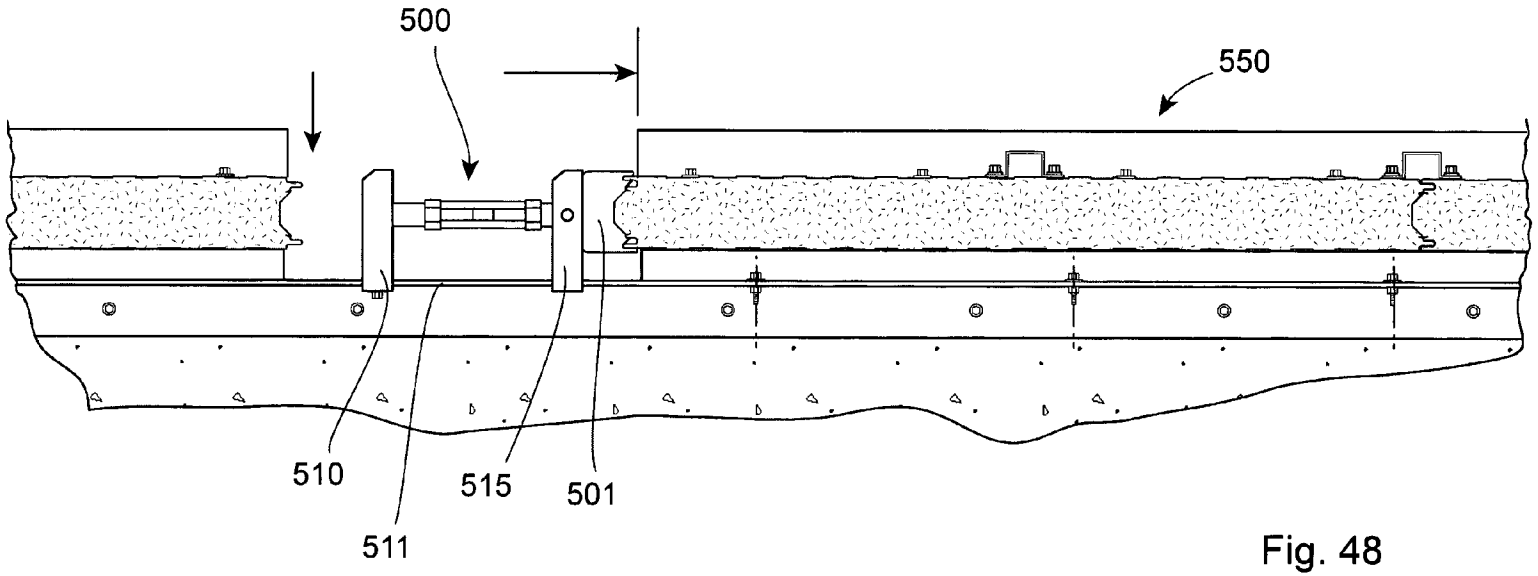
FIG. 48 is a cross sectional view illustrating the jointing of one module to another module.
Figure 49:
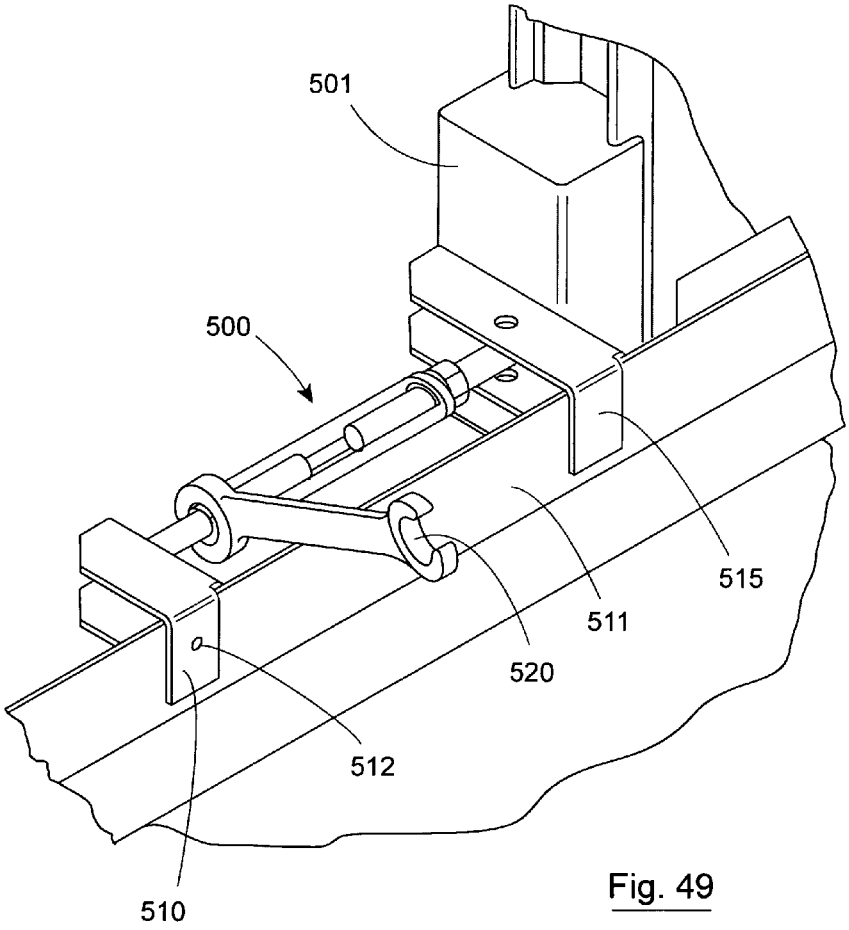
FIG. 49 is perspective view of a tool used in jointing adjacent modules.

Referring now to FIGS. 47 to 49 the mounting of a second module 401 to the installed first module 400 is illustrated. The first module 400 is fixed in place before the second module 401 is presented to the first module 401. It will be noted that the opposite ends of each module have male and female panel joint—forming connectors so that adjacent modules can be interengaged in the same way as the individual panels in a module can be interengaged. A clamping tool with a block 501 is used to push the second panel into engagement with the pre-installed first module. The clamping tool 500 comprises a rear bracket 510 which is hooked over an angle support 511 and fixed using a self tapping screw inserted through a hole 512. The tool 500 also comprises a front bracket 515 which is also hooked over but not fixed to the angle support 511. A wrench is used to turn a screw which moves the front bracket 515 away from the rear bracket 510 and a pushing force is applied via the block 501 to the end of the panel module 550, forcing the panel module into engagement with the adjacent panel module at an opposite end of the module 550. There may be clamping devices top and bottom to spread the pushing force applied. The clamping devices are readily operated from the inside of the building. When the modules are interengaged the clamping devices are removed.

Each module bridges between the building slabs above and below, for example a ground floor and the floor of a first storey of the building. The modules used to fill this building opening are connected together as described. Similarly, the separate modules used to bridge the next building opening above the first opening are interconnected. The seat 320 and membrane 321 seal the gap between upper and lower modules. Beads of flexible butyl or the like may be applied at the various joints, both horizontal and vertical, to provide additional sealing between adjacent modules.

Figure 50:
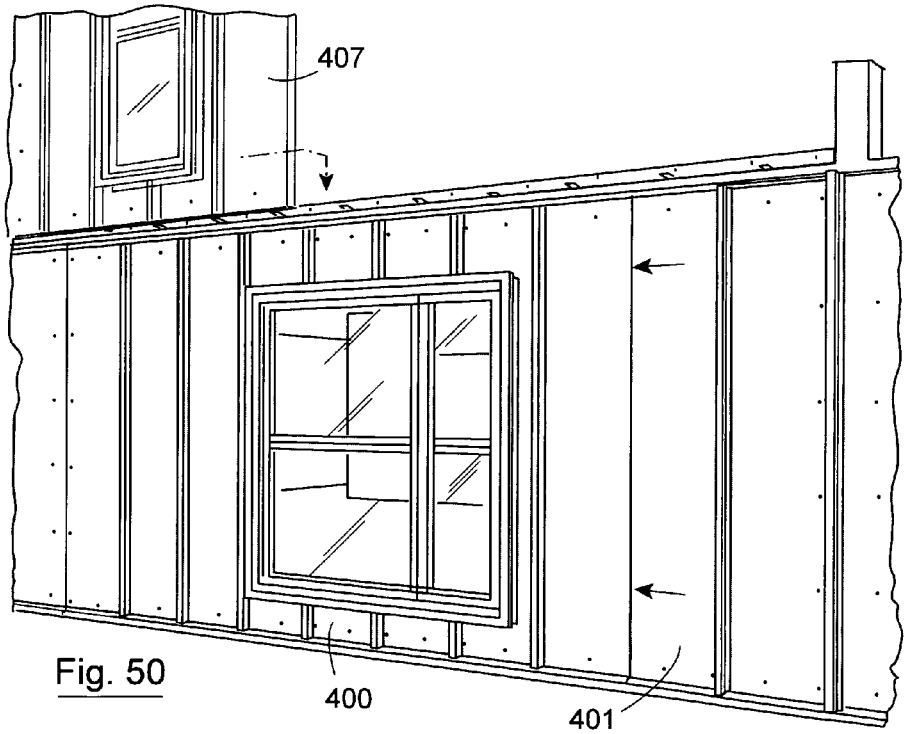
FIG. 50 is a perspective view illustrating the mounting of another module above the interconnected lower modules of FIG. 47.
Figure 51:
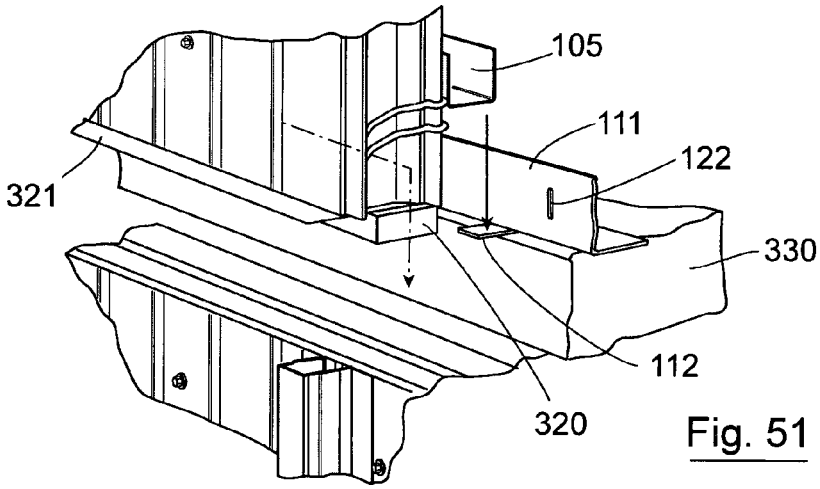
FIGS. 51 to 53 are perspective views illustrating the stack joint detail between upper and lower modules.
Figure 52:
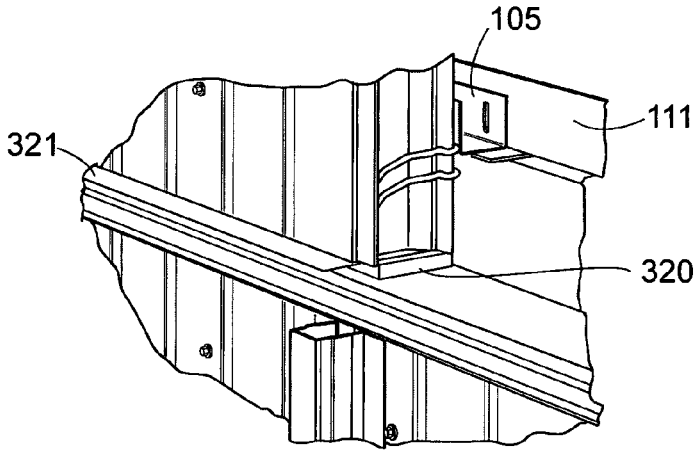
Figure 53:
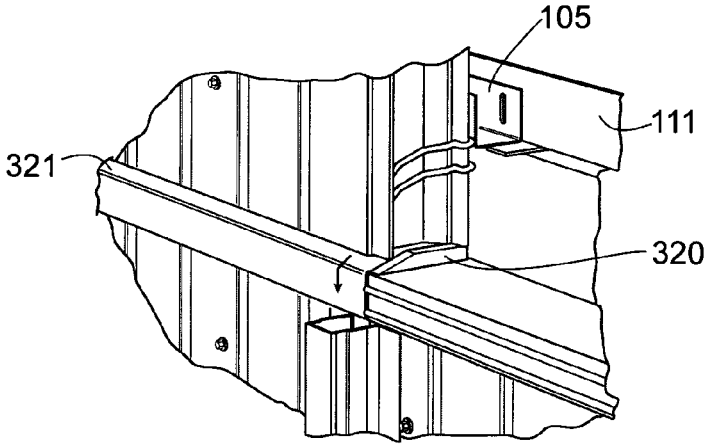

FIG. 50 is a perspective view illustrating the mounting of another module 407 above the interconnected lower modules of FIG. 47. FIGS. 51 to 53 are perspective views illustrating the stack joint detail between upper and lower modules similar to that of FIGS. 29 and 30. In particular FIGS. 51 to 53 illustrate how a membrane part 321 of EPDM or the like can be folded down over a joint between upper and lower modules.

Figure 54:
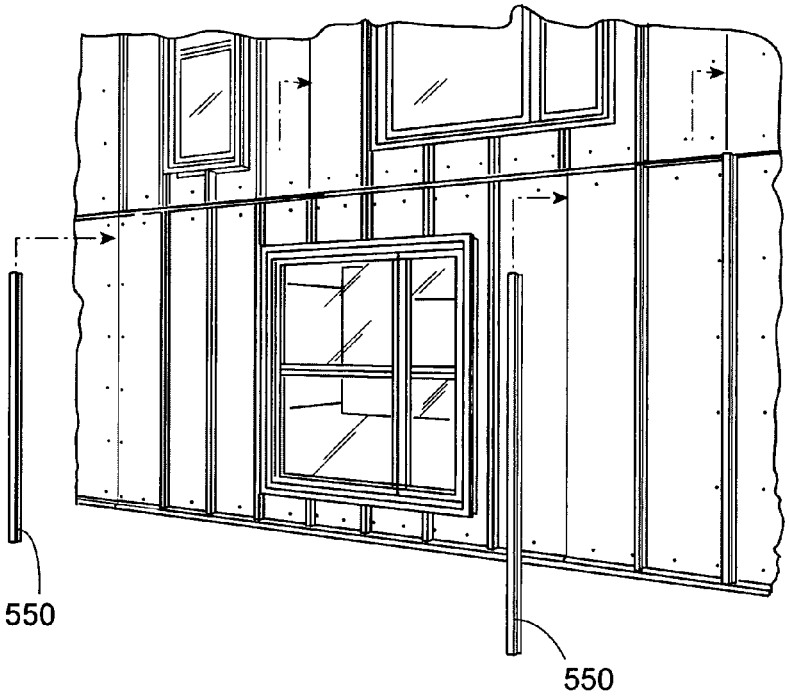
FIG. 54 is a perspective view illustrating the mounting of reinforcing elements at a joint between adjacent modules.
Figure 55:
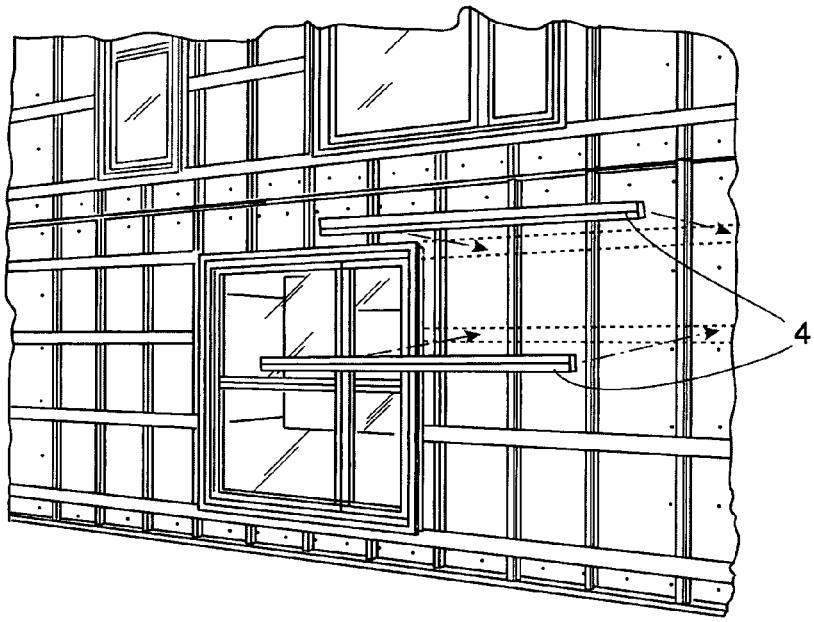
FIG. 55 is a perspective view illustrating the mounting of supports elements to the modules.
Figure 56:
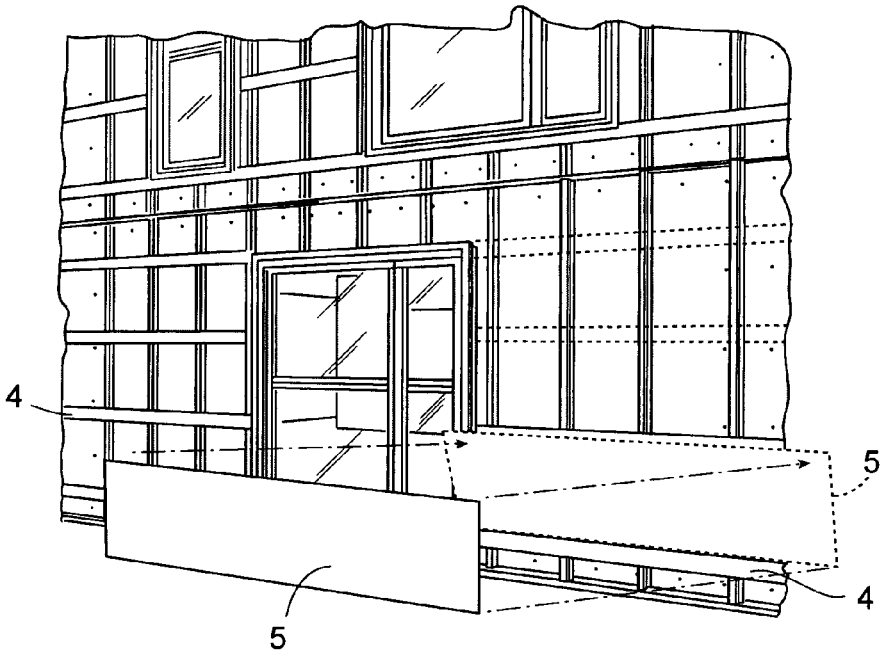
FIG. 56 is a perspective view illustrating the mounting of cladding elements to the support elements.

The vertical joint between adjacent modules may be bridged by a top hat reinforcement element 550 as described above and further illustrated in FIG. 54. The external cladding may then be readily applied, for examples (as illustrated in FIGS. 55 and 56) using rails 4 which are fixed to the outer top hat reinforcing elements and cladding panels 5 of any suitable type which are in turn attached to the rails.

The system of the invention uses composite insulating panels in a revolutionary way. There is no need for secondary support steelwork to support the panels. The individual panels in a module act as a single monolithic structure forming a diaphragm and allowing gravity loads to be distributed sideways to the support columns of a building. The system undergoes very small deflection under wind loading and is sufficiently stiff to support an external facade and a brittle internal façade such as plasterboard.

The top hat reinforcement elements used to interconnect adjacent panels in a module ensure that the composite panels act together as monolithic structure that creates a diaphragm while providing a surface to which cladding can be fixed and also providing a cavity between the panels and the cladding attached to the modules. They stiffen the panels and thereby enhance resistance to deflection. The reinforced panels create a wall that distributes its own self weight, as a diaphragm, to the points of no deflection, at the building columns. The modules are pre-fabricated and readily craned into position on site, allowing the building to be rendered weather resistant by mounting the modules in place from the inside of the building. The system is cost effective and relatively easy and quick to install.

A typical maximum module size would be 7 m wide by 3 m high. Such individual modules are fixed together to form larger bays. Some of the modules may include a framed opening such as a window opening which may be 2 m high× 1.7 m wide for a 3 m panel span.

The angle head and base support brackets are packed up with shims to suit a required finished floor level. A module is then mechanically lifted into position and when the module has been levelled the U-section head and base support are fixed to the head and base supports brackets. An adjoining panel module is lifted and similarly fixed into position. The clamping device ensures that a tight fit is achieved at the interconnection between the adjoining modules. The individual modules at the same level are then stitched together by further top hat reinforcing elements.

Modifications and additions can be made to the embodiments of the invention described herein without departing from the scope of the invention. For example, while the embodiments described herein refer to particular features, the invention includes embodiments having different combinations of features. The invention also includes embodiments that do not include all of the specific features described.

The invention is not limited to the embodiment hereinbefore described, with reference to the accompanying drawings, which may be varied in construction and detail.

The invention claimed is:

1. A structural infill wall panel module for mounting to a frame of a building, the module comprising:— a plurality of composite insulating panels;

the panels comprising an external sheet, an internal lining sheet, and an insulating core between the external sheet and the internal sheet, the external sheet and the internal sheet having profiled connection parts, the profiled connection parts of the external sheets of adjacent panels being interengagable and the connection parts of the internal sheets of adjacent panels being interengagable at the joint between adjacent panels;

external reinforcing elements mounted to the external sheets and bridging the joint between adjacent panels;

internal reinforcing elements mounted to the internal sheets and bridging the joint between adjacent panels; and mounting brackets for attachment to an element of a building;

wherein the mounting brackets comprise an upper mounting bracket and a lower mounting bracket for attachment to upper and lower elements of a building.

2. The panel module as claimed in claim 1 wherein the external reinforcing elements are of substantially top hat shape having side flanges mounted to the external sheets of adjacent panels forming a joint.

3. The panel module as claimed in claim 1 wherein the internal reinforcing elements are of substantially top hat shape having side flanges mounted to the internal sheets of adjacent panels forming a joint.

4. The panel module as claimed in claim 2 comprising additional reinforcing elements mounted to the panels intermediate the sides thereof.

5. The panel module as claimed in claim 4 wherein the additional reinforcing elements are mounted to the external sheets of the panels.

6. The panel module as claimed in claim 5 wherein a single additional reinforcing element is mounted to the external sheet of a panel intermediate the sides thereof.

7. The panel module as claimed in claim 4 wherein the additional reinforcing elements are of substantially top hat shape having side flanges mounted to the sheet.

8. The panel module as claimed in claim 1 wherein the panels are approximately 1200 mm in width.

9. The panel module as claimed in claim 8 wherein the external reinforcing elements are spaced apart by a distance of about 600 mm.

10. The panel module as claimed in claim 1 wherein the upper and lower elements of the building to which the brackets are attached are slotted to accommodate movement of the panel module relative to the upper and lower elements of the building to which it is attached.

11. The panel module as claimed in claim 1 wherein the mounting brackets are mounted to the internal sheet of the panel.

12. The panel module as claimed in claim 11 comprising panel fixings extending through the panel and into the brackets.

13. The panel module as claimed in claim 1 comprising a support member extending longitudinally between the brackets.

14. The panel module as claimed in claim 13 comprising panel fixings extending through the panel and into the longitudinal support member.

15. The panel module as claimed in claim 1 comprising a flexible seal system at one end of the module for sealing the joint between adjacent modules, on assembly of the module to another like module.

16. The panel module as claimed in claim 15 wherein the flexible seal comprises a flexible membrane and a block of a compressible material carried by the membrane.

17. The panel module as claimed in claim 1 comprising an integral window or door and a frame comprising vertical and horizontal framing system for framing the window or door.

18. The panel module as claimed in claim 17 wherein the framing system comprises a pair of interengagable frame members.

19. The panel module as claimed in claim 18 wherein one frame member is of channel shape and the other frame member is of C-section.

20. The panel module as claimed in claim 18 wherein the frame members are fixed together, for example by rivets.

21. The panel module as claimed in claim 18 wherein the vertical and horizontal framing systems are fixed together at a joint therebetween.

22. The panel module as claimed in claim 21 wherein the horizontal and vertical framing systems are fixed together using an L-shaped bracket.

23. The panel module as claimed in claim 18 wherein the vertical framing system extends for the full height of the facade system.

24. The panel module as claimed in claim 1 wherein the external sheet is of metal such as galvanised steel.

25. The panel module as claimed in claim 1 wherein the internal liner sheet is of metal such as galvanised steel.

26. A facade system comprising at least one panel module as claimed in claim 1.

27. The facade system as claimed in claim 26 comprising support elements mounted to the external reinforcing bridging elements.

28. The facade system as claimed in claim 27 comprising cladding elements mounted to the support elements.

* * * * *